US009523188B2

(12) United States Patent
Rahimzadeh et al.

(10) Patent No.: US 9,523,188 B2
(45) **Date of Patent: *Dec. 20, 2016**

(54) FRAMING STRUCTURE

(71) Applicant: DIVERSAKORE LLC, Alpharetta, GA (US)

(72) Inventors: Housh Rahimzadeh, Alpharetta, GA (US); Marc Rahimzadeh, Alpharetta, GA (US)

(73) Assignee: DIVERSAKORE LLC, Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/817,399

(22) Filed: Aug. 4, 2015

(65) Prior Publication Data

US 2016/0032580 A1 Feb. 4, 2016

Related U.S. Application Data

(63) Continuation-in-part of application No. 14/016,077, filed on Aug. 31, 2013, now Pat. No. 9,096,999, which is a continuation of application No. 12/665,958, filed as application No. PCT/US2008/067724 on Jun. 20, 2008, now Pat. No. 8,800,229.

(60) Provisional application No. 60/945,700, filed on Jun. 22, 2007.

(51) Int. Cl.

| | |
|---|---|
| ***E04H 12/00*** | (2006.01) |
| ***E04B 1/30*** | (2006.01) |
| ***E04B 5/40*** | (2006.01) |
| ***E04B 5/19*** | (2006.01) |
| ***E04C 3/293*** | (2006.01) |
| *E04B 1/24* | (2006.01) |

(52) U.S. Cl.

CPC . *E04B 1/30* (2013.01); *E04B 5/19* (2013.01); *E04B 5/40* (2013.01); *E04C 3/293* (2013.01); *E04B 2001/2415* (2013.01); *E04B 2001/2454* (2013.01)

(58) Field of Classification Search

CPC ..... E04B 2001/2406; E04B 2001/2415; E04B 2001/2451; E04B 2001/2454; E04B 2001/2478; E04B 2001/2484; E04B 1/24; E04B 1/2403; E04B 1/30; E04B 1/1903

USPC ..... 52/236.7, 283, 637, 838, 349, 635, 250, 52/648.1, 653.2, 655.1, 849, 649.2, 653.1, 52/251

See application file for complete search history.

(56) References Cited

U.S. PATENT DOCUMENTS 3,540,177 A * 11/1970 Slining ..... E04B 1/24 52/235
3,788,024 A * 1/1974 De Hartog ..... E04B 1/2403 52/283
4,037,375 A * 7/1977 Maggos ..... E04B 5/48 249/26
4,125,973 A * 11/1978 Lendrihas ..... E04B 1/165 249/188
4,722,156 A * 2/1988 Sato ..... E04C 3/34 52/834

(Continued)

*Primary Examiner* — Mark Wendell
(74) *Attorney, Agent, or Firm* — Parks IP Law LLC; Stephen J. Terrell

(57) ABSTRACT

A framing structure includes elements that are integrally connected by a poured bonding core. The elements include a hollow-interior column and a beam having a cavity that is configured to receive a pourable bonding material. The hollow interior of the column and the cavity of the beam form a continuous volume that is configured to receive a pourable bonding material.

19 Claims, 15 Drawing Sheets

(56) References Cited

U.S. PATENT DOCUMENTS 4,723,384 A * 2/1988 Mengeringhausen .... E04B 1/24 52/126.1
5,050,358 A * 9/1991 Vladislavic ..... E04B 1/161 52/250
5,289,665 A * 3/1994 Higgins ..... E04B 1/2403 211/191
5,678,375 A * 10/1997 Juola ..... E04B 1/24 52/236.7
5,867,964 A * 2/1999 Perrin ..... E04C 2/384 52/236.8
5,941,035 A * 8/1999 Purse ..... E04B 5/29 52/252
5,978,997 A * 11/1999 Grossman ..... E01D 2/02 14/73
6,092,347 A * 7/2000 Hou ..... A01G 9/14 52/302.1
6,625,943 B1 * 9/2003 Renner ..... E04B 1/165 52/250
6,694,700 B1 * 2/2004 Mackett ..... E04B 1/0046 403/205
6,837,016 B2 * 1/2005 Simmons ..... E04B 1/2403 403/173
6,959,515 B1 * 11/2005 Beighton ..... E04B 1/3483 52/236.7
7,143,554 B2 * 12/2006 Sachs ..... E04C 3/34 52/232
D598,219 S * 8/2009 Sparks, Jr. ..... D8/349
8,056,291 B1 * 11/2011 diGirolamo ..... E04B 5/19 52/250
8,474,204 B2 * 7/2013 Pan ..... E04B 1/30 52/259
8,640,419 B2 * 2/2014 Lee ..... E04C 3/44 52/649.2
8,800,229 B2 * 8/2014 Rahimzadeh ..... E04B 1/30 52/251
9,096,999 B2 * 8/2015 Rahimzadeh ..... E04B 1/1903
9,103,132 B2 * 8/2015 Simmons ..... B66C 1/62
2003/0115825 A1 * 6/2003 Crump, Jr. ..... E04C 5/16 52/704
2009/0069598 A1 * 3/2009 Bayer ..... C07F 9/3873 564/15

* cited by examiner 26
20c
20d
12
4
10
20a
20b
22b
22a
14b
28b
3
16
36a
60
60
4
38b
24
34a
16
38a
32a
30
32b
28a
34b
14a
3

10
54
18
22
C
C
54
R1
R1
60
52
52
60
34a
34b
16
16
32a
42
42
32b
28
24
30
12
14
20

FRAMING STRUCTURE

CROSS-REFERENCE TO RELATED APPLICATIONS

This application claims priority to U.S. Application No. 60/945,700, filed Jun. 22, 2007 and PCT Application No. PCT/US08/67724, filed Jun. 20, 2008, the entirety of which is incorporated herein by reference.

TECHNICAL FIELD

This disclosure relates generally to building construction and, more specifically, to a support structure with improved performance characteristics and a method for forming thereof.

BACKGROUND

In the field of building construction, and specifically with respect to the erection of multi-story buildings, the frame or framing structure is the main load-bearing structure of a building that maintains the stability and structural integrity of the building. The typical multi-story framing structure consists of a plurality of columns that are interconnected with beams and flooring sections that are supported by the beams.

SUMMARY

There is a need for an improved framing structure for use with multi-story buildings. Such a framing structure provides a building that better withstands dynamic loads caused by high winds, blasts, impacts, and similar destructive effects. These and other aspects of the present disclosure will become readily apparent from the description provided herein.

The various embodiments of the present disclosure provide a framing structure having a poured bonding core that integrally connects columns, beams, and flooring sections. The exemplary embodiments teach a framing structure having elements that are quickly erected and then integrally connected with a poured bonding core. The method of forming the framing structure virtually eliminates temporary shoring and temporary forms. Further, a poured bonding core is easily formed as elements of the framing structure are arranged to channel a pourable bonding material into each of the elements. Since the pourable bonding material flows into each of the elements, all of the elements are integrally connected to one another by the poured bonding core, and the framing structure has increased strength and rigidity.

As used herein, the term "bonding" is used to include materials that can form structures that link, connect, form a union between, or attach multiple structures to form a composite structure. As used herein, the term "pourable" is used to include material in a state where the material conforms to the shape of the container in which it is poured. The term "core" is used to include a structure that has solidified to form a substantially rigid structure. These terms are used for purposes of teaching and in a non-limiting manner.

According to an exemplary embodiment, the columns each have a hollow interior and the beams each have cavities that are configured to receive a pourable bonding material. The columns have openings to the hollow interiors and the beams are positioned to extend between adjacent columns such that the cavities thereof align with the openings in the adjacent columns. Thus, a pourable bonding material that is poured into the cavity of a beam flows through the openings and into the hollow interiors of the adjacent columns. Alternatively, the hollow interior is directly filled with the pourable bonding material and then the cavity is filled. In either case, both the hollow interiors of the columns and the cavities of the beams are filled with the pourable bonding material and, as the pourable bonding material solidifies to form a poured bonding core, the columns and the beams are integrally connected to one another. The columns and beams are efficiently erected to form the shell of the framing structure and the poured bonding core provides strong, rigid connections between the columns and beams.

In general, the beams support flooring sections. In certain embodiments, the flooring sections are pre-cast concrete planks that are supported such that ends thereof further define or are adjacent to the cavities of the beams. The pre-cast concrete planks include hollow voids in their ends such that, as the cavities are filled with the pourable bonding material, the hollow voids are also filled with the pourable bonding material to further integrally connect the flooring sections with the columns and beams. In still other embodiments, the pourable bonding material fills the hollow interiors, cavities, and hollow voids and is further poured to create a layer over the top of the flooring sections. This provides even greater integration between the column, beam, and flooring section elements of the framing structure. In alternative embodiments, the flooring sections can be wood planks, metal decking, poured-in-place concrete planks, solid pre-cast planks, double T pre-cast sections, single T pre-cast sections, pan-formed sub flooring, combinations thereof, and the like. In these embodiments, the poured bonding material can be poured to create a top layer that integrates the flooring sections.

To improve the strength of the poured bonding core, or otherwise to improve the strength of the connection between the poured bonding core and the other elements of the framing structure, reinforcing elements are included in the columns and beams. Specifically, studs are attached or integral to the beams and are positioned in the cavities. Additionally, lengths of rebar are positioned in the cavities of the beams and in the hollow interiors of the columns. To strengthen the connection between a column and an abutting beam, a length of rebar that is positioned within the cavity of the beam can extend through an opening in the column into the hollow interior. Where a column is disposed between abutting beams, a length of rebar can extend through opposed openings and through the hollow interior of the column so as to be positioned in the cavities of the abutting beams. The lengths of rebar that are positioned within the cavities so as to extend into or through the hollow interiors can be tied to the lengths of rebar that are positioned within the hollow interiors.

To improve the efficiency of the process of positioning the lengths of rebar in the cavities, the studs are formed with a structure to which rebar can be easily tied or attached. The studs can be formed of round bar, rebar, flat bar, any dimensional metal stock, combinations thereof, and the like. Means for attaching the lengths of rebar to the studs includes ties, welding, adhesive, combinations thereof, and the like. Further, the studs can be attached to the lengths of rebar prior to attaching the studs to the beams.

The foregoing has broadly outlined some of the aspects and features, which should be construed to be merely illustrative of various potential applications. Other beneficial results can be obtained by applying the disclosed information in a different manner or by combining various aspects of the disclosed embodiments. Accordingly, other aspects and a more comprehensive understanding of the disclosure may be obtained by referring to the detailed description of the exemplary embodiments taken in conjunction with the accompanying drawings, in addition to the claims.

DETAILED DESCRIPTION

As required, detailed embodiments are disclosed herein. It must be understood that the disclosed embodiments are merely exemplary examples of various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present disclosure. Therefore, specific structural and functional details disclosed herein are not to be interpreted as limiting, but merely as a basis for the claims and as a representative basis for teaching one skilled in the art.

Figure 1:
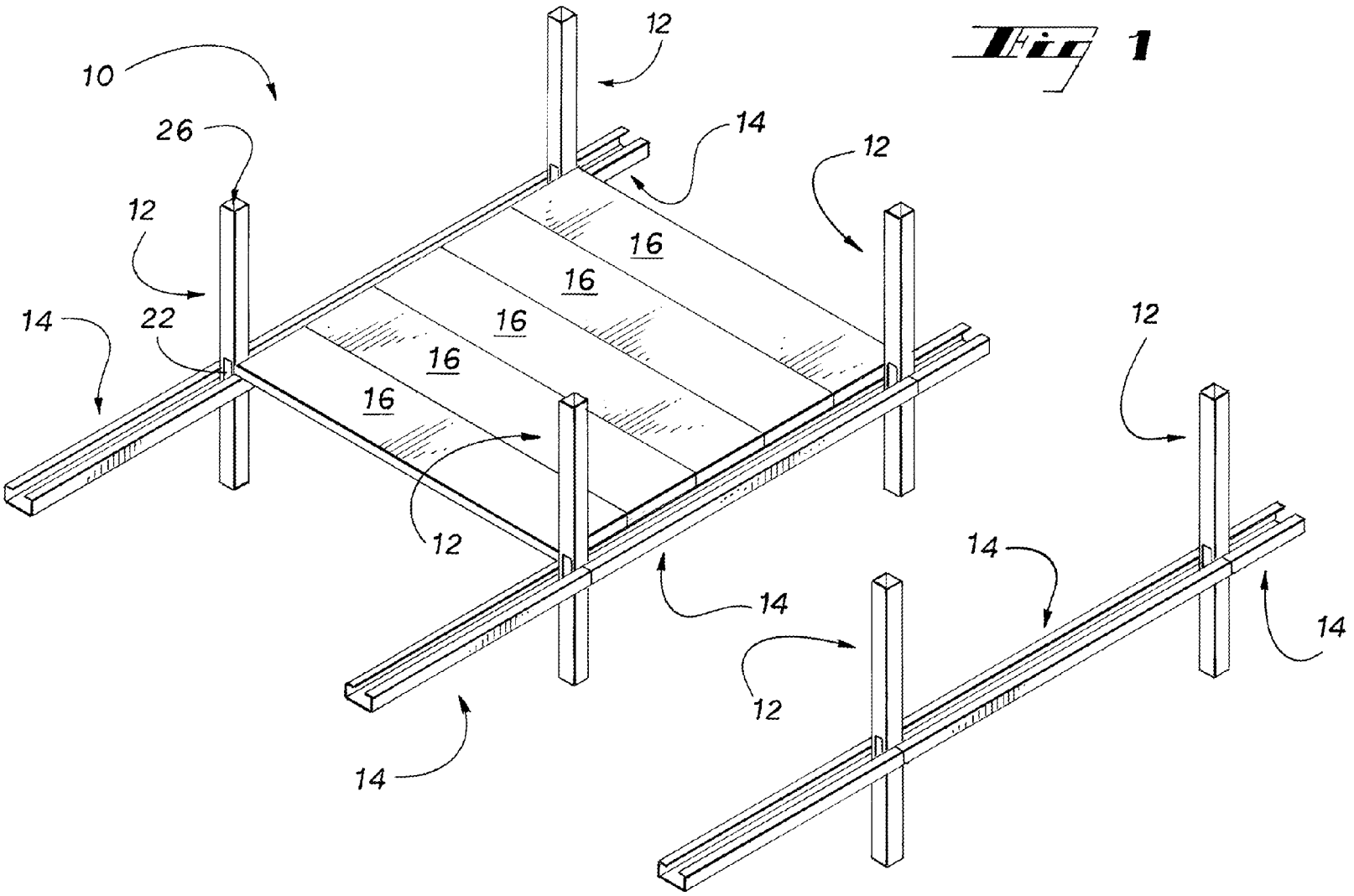
FIG. 1 is a partial perspective view of a framing structure, according to an exemplary embodiment.
Figure 8:
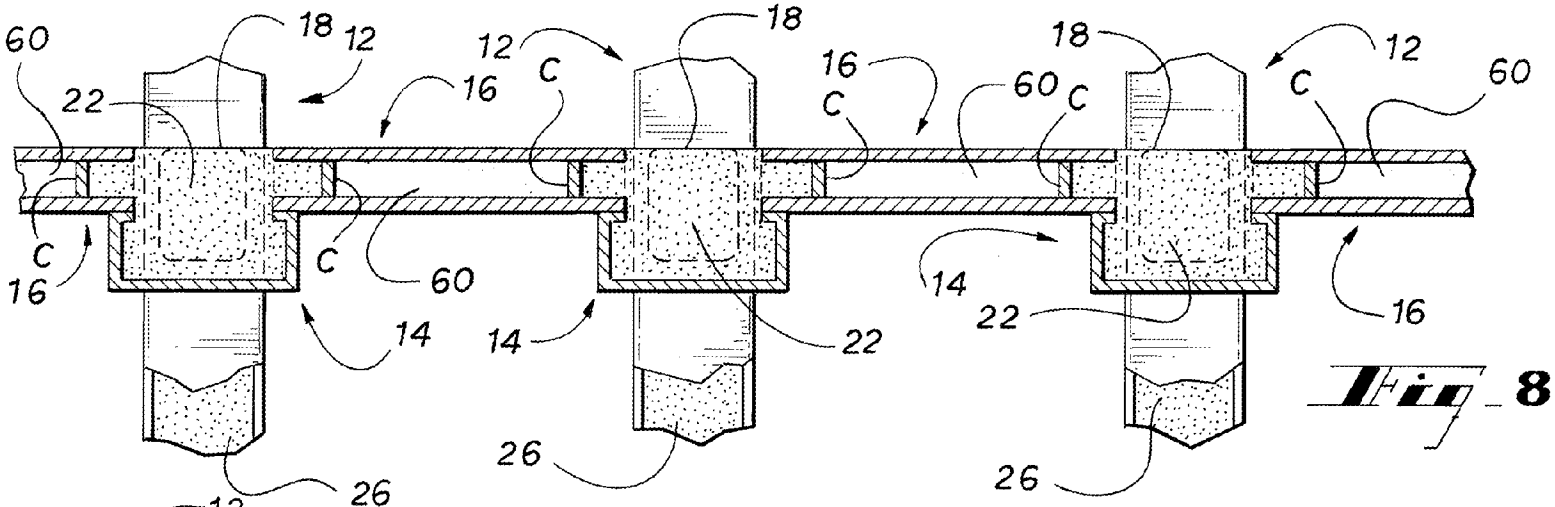
Figure 9:
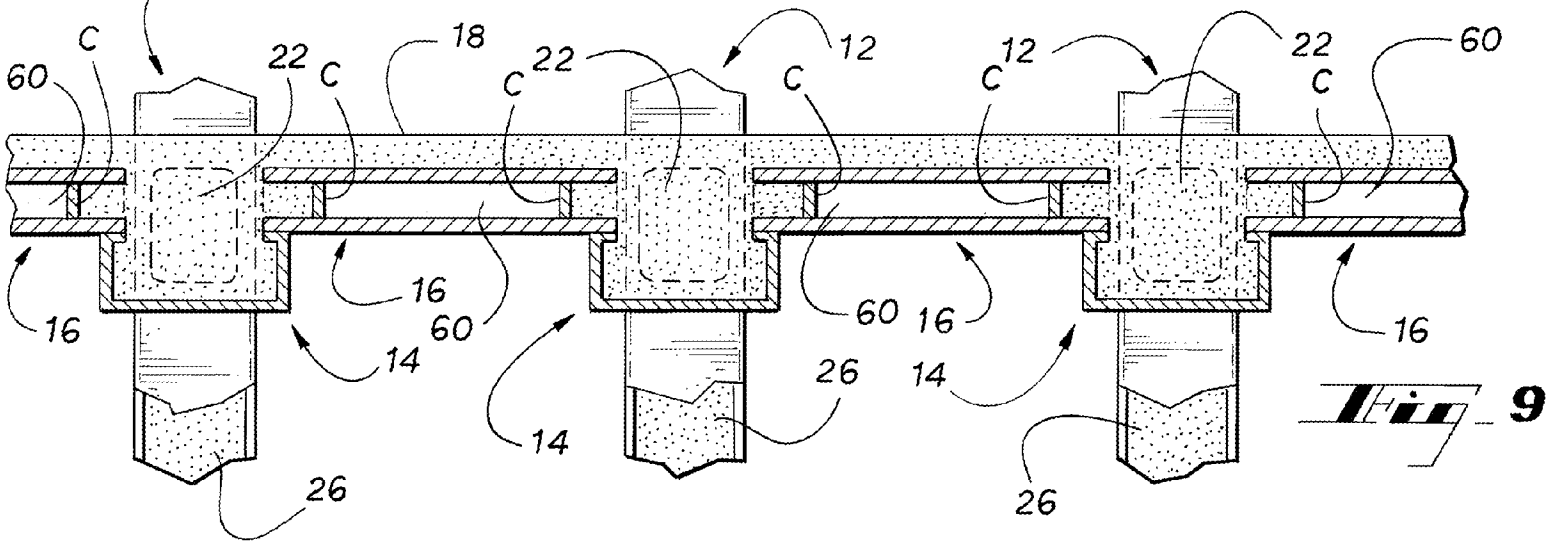

Referring to FIG. 1, an exemplary embodiment of a framing structure 10 includes a plurality of columns 12, a plurality of beams 14, a plurality of flooring sections 16, and a poured bonding core 18 (shown in FIGS. 8 and 9). The exemplary columns 12, beams 14, and flooring sections 16 can be formed from material or materials that have characteristics which meet minimum performance requirements including steel, aluminum, wood, pre-cast concrete, composite materials, combinations thereof, and the like. Referring momentarily to FIGS. 8, and 9, the poured bonding core 18 is pourable bonding material 18 that has solidified. As used herein, the term pourable bonding material is used to include a bonding material in a moldable or substantially liquid state and the term poured bonding core is used to include a bonding material in a substantially rigid state. Such bonding materials can include concrete, plasticized materials, cementitious materials, cement, grout, Gyperete®, combinations thereof, and the like.

Continuing with FIG. 1, generally described, the beams 14 extend in a longitudinal direction and the ends thereof are supported by columns 12 at a height that corresponds to a floor or level of the framing structure 10. Flooring sections 16 extend in a transverse direction and the ends thereof are supported by beams 14. The flooring sections 16 define a base layer of a floor or level of the framing structure 10. As will be described in further detail below, the poured bonding core 18 integrates the columns 12, the beams 14, and the flooring sections 16 such that the framing structure 10 is substantially unitary and has improved structural characteristics.

Referring to FIGS. 2-5, the elements of the framing structure 10 are described in further detail. Here, the illustrated framing structure 10 is formed from pluralities of like-numbered elements that are substantially similar. For clarity, a representative one or representative ones of the like-numbered elements are described in detail, although this description is generally applicable to each of the other like-numbered elements. Further, numbers alone are used to generally reference a like-numbered element or group of like-numbered elements and suffixes such as "a" or "b" are attached to the numbers in order to reference individual ones of the like-numbered elements. For example, a wall of the column 12 can be generally referenced as wall 20 or individually referenced as wall 20*a*, 20*b*, 20*c*, or 20*d*.

Figure 2:
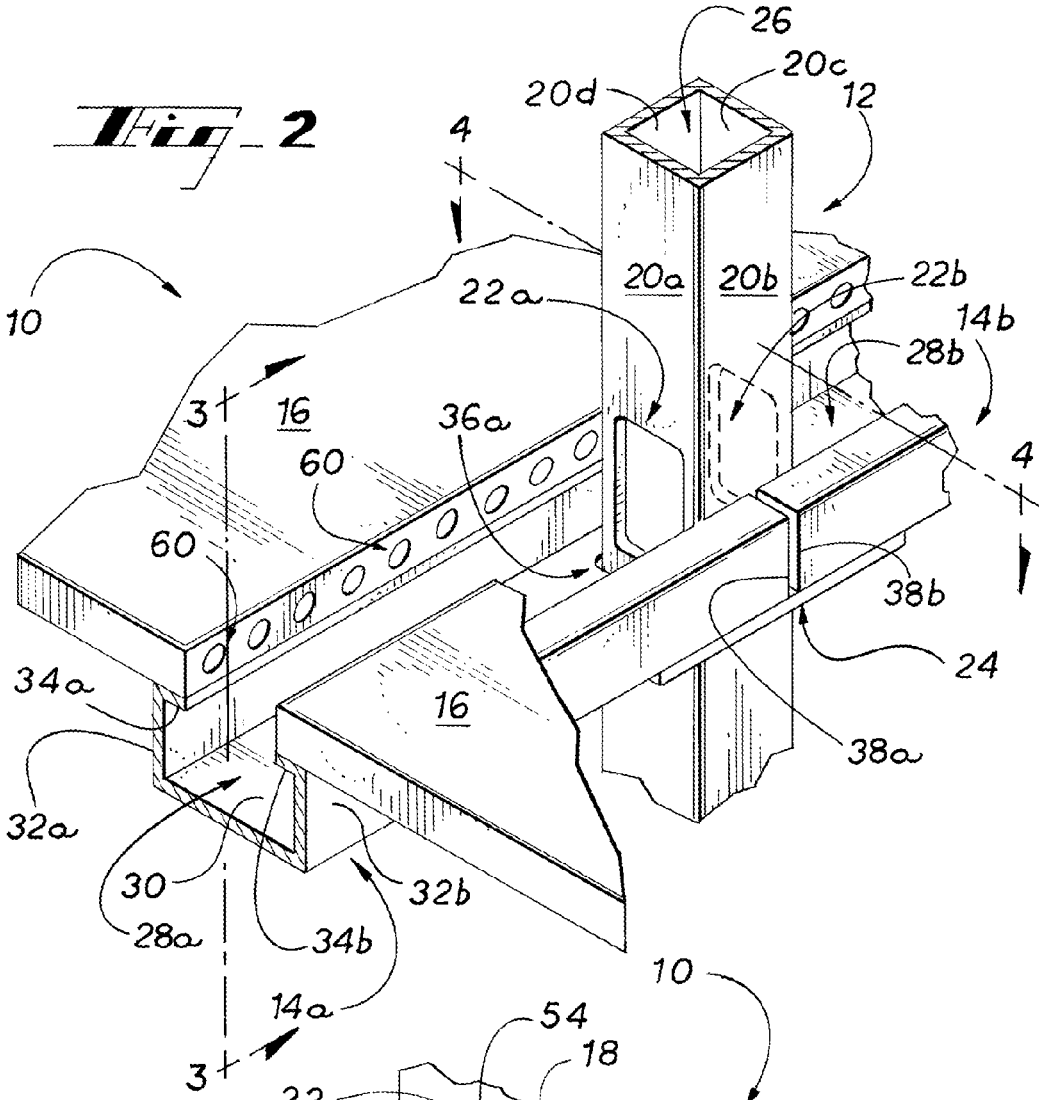
FIG. 2 is a fragmentary perspective view of elements of the framing structure of FIG. 1.
Figure 3:
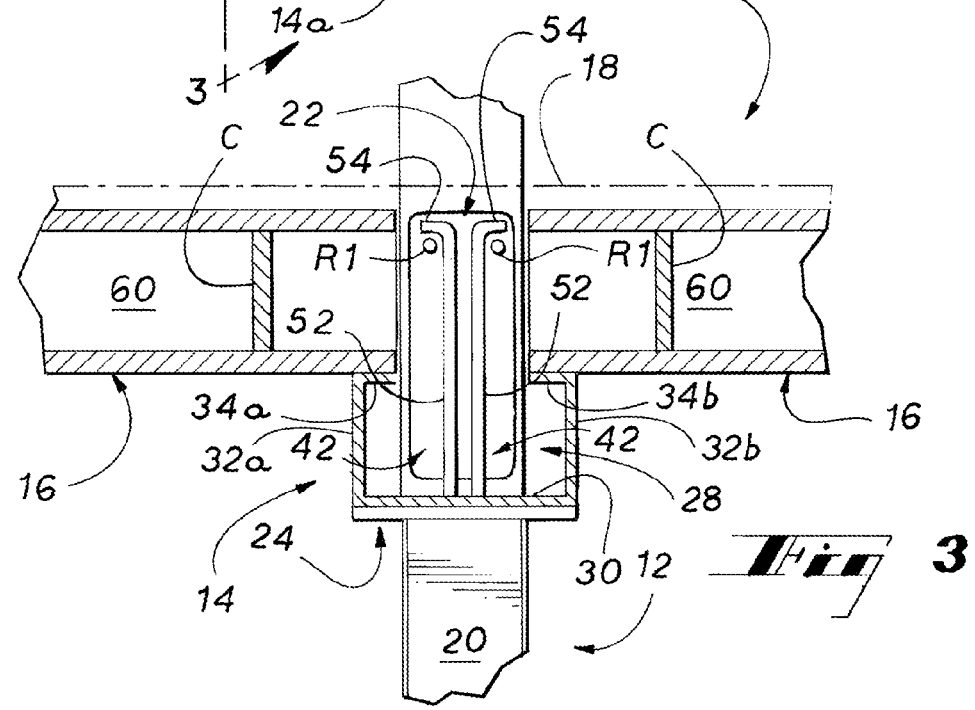
FIG. 3 is a fragmentary cross-sectional end view of elements of the framing structure of FIG. 1.
Figure 4:
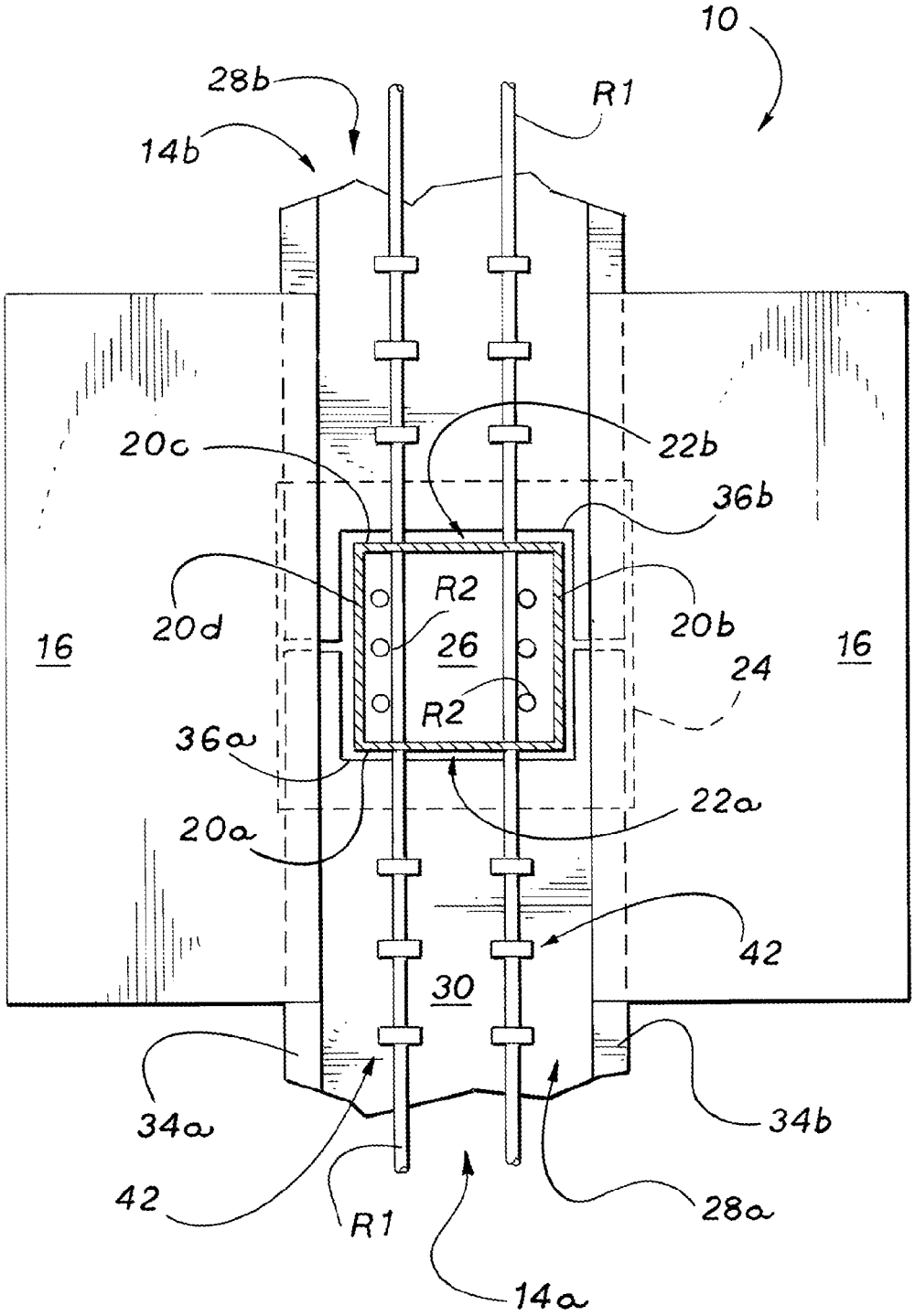
FIG. 4 is a fragmentary cross-sectional plan view of elements of the framing structure of FIG. 1.

Referring now to FIGS. 2-4, the illustrated column 12 is a hollow-interior, box-style beam having a substantially square cross-section defined by four walls 20. The column 12 includes openings 22 that are disposed in certain of the walls 20 so as to provide a passageway between the exterior and the interior 26 of the column 12. The size, shape, and number of openings 22 are determined so as to allow a pourable bonding material 18 to flow through the openings 22 without substantially adversely affecting the structural integrity of the column 12.

The illustrated openings 22 are disposed in the column 12 at positions that generally correspond to where the ends of beams 14 substantially meet the column 12. In other words, the openings 22 are positioned to generally correspond to the floors or levels of the framing structure 10. Referring next to FIGS. 2 and 3, the columns 12 and the beams 14 are positioned with respect to one another such that the openings 22 of the columns 12 substantially align with cavities 28 of the beams 14.

Continuing with reference to FIGS. 2-4, in the illustrated embodiment the column 12 includes openings 22*a*, 22*b* in opposed walls 20*a*, 20*c*, respectively. Such an arrangement allows a pourable material to fill the column 12 quicker than if the column 12 had a single opening 22. Further, the openings 22*a*, 22*b* are substantially aligned with one another and with cavities 28*a*, 28*b* of beams 14*a*, 14*b* such that, as described in further detail below, lengths of rebar R1 can extend within the cavities 28*a*, 28*b* and through the openings 22*a*, 22*b* to, along with lengths of rebar R2 within the hollow interior 26 and the poured bonding core 18, provide what the Applicant anticipates is an unexpectedly stronger connection between the column 12 and the beams 14.

Generally described, the illustrated framing structure 10 includes a structure that is configured to position an end of a beam 14 with respect to a column 12. In the embodiment illustrated in FIGS. 2-4, the positioning structure is a saddle 24 that is attached or integral to the column 12 and supports substantially abutting ends 38*a*, 38*b* of the beams 14*a*, 14*b*. The illustrated saddle 24 is positioned vertically beneath the openings 22*a*, 22*b* such that, as the ends 38*a*, 38*b* of the beams 14*a*, 14*b* are supported thereon, the cavities 28*a*, 28*b* of the beams 14*a*, 14*b* are aligned with the openings 22*a*, 22*b*.

Generally described, the saddle 24 is a plate, erection angle, or L-bracket, although it should be understood that a positioning structure can include any structure that provides a support ledge or surface for the ends 38 of beams 14 including a fin or protrusion that is integral to the column 12, a slot or recess in the column 12, combinations thereof, and the like. Further, a positioning structure can include a portion of the beam 14 that is configured to set on a ledge or insert into an opening, slot, or recess in the column 12.

Referring to FIGS. 2-5, the beam 14 has a trough-like or channel-like structure in the form of an upward facing cavity 28 that functions to receive and retain pourable materials. The exemplary beam 14 has a squared, U-shaped cross-section, although, in alternative embodiments, the cross-section of the beam 14 can be V-shaped, rounded U-shaped, H-shaped, and any other shape that provides the functionality described herein.

Figure 5:
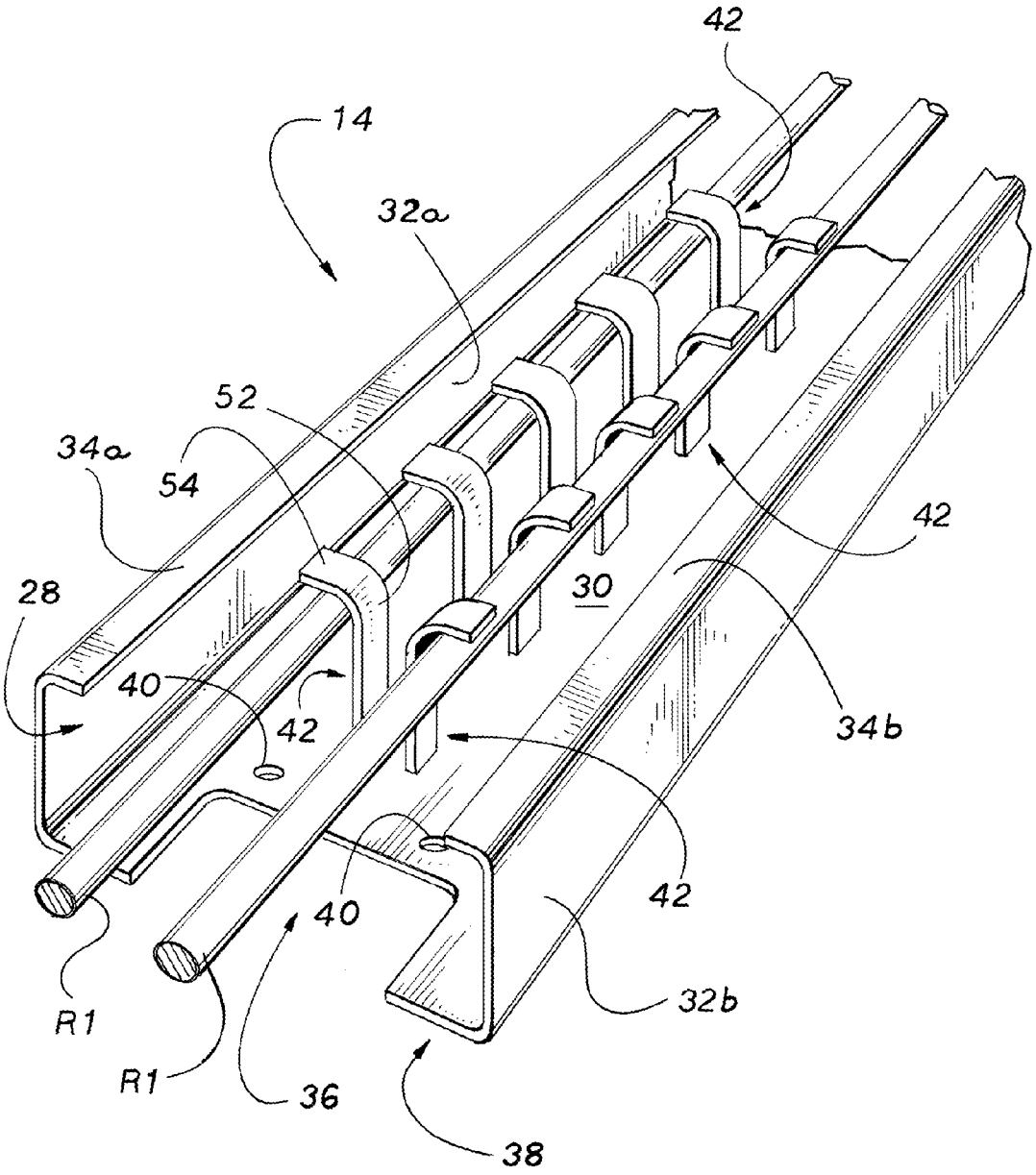
FIG. 5 is a fragmentary perspective view of a beam of the framing structure of FIG. 1.

Referring now to FIGS. 2, 3, and 5, the beam 14 includes a base wall 30 and side walls 32*a*, 32*b* that extend vertically upward from the base wall 30 so as to define the cavity 28 of the beam 14. Cantilevers 34*a*, 34*b* extend inwardly from the upper ends of the side walls 32*a*, 32*b* to provide a surface for supporting flooring sections 16, as described in further detail below. Alternatively, the cantilevers 34*a*, 34*b* can be arranged to extend outwardly from the sidewalls 32, one cantilever can extend inwardly and the other outwardly, or cantilevers can extend both inwardly and outwardly.

Continuing with FIGS. 2, 3, and 5, a cutout 36 is defined in the base wall 30 at each of the ends 38 of the beam 14. The cutout 36 is dimensioned with respect to the column 12 such that the column 12 can be received in the cutout 36. Accordingly, in the illustrated embodiment, the cutout 36 is squared to correspond to the squared cross-section of the column 12. The depth of the illustrated cutout 36 is substantially equal to half of the depth of the column 12 and the width of the illustrated cutout 36 is substantially equal to the width of the column 12. Thus, as illustrated in FIGS. 2 and 4, when the column 12 is received in the cutouts 36*a*, 36*b* of the beams 14*a*, 14*b*, the ends 38*a*, 38*b* of the beams 14*a*, 14*b* substantially abut one another to, in effect, provide a continuous beam 14.

Referring momentarily to FIG. 5, apertures 40 are defined in the base wall 30, adjacent the cutout 36, to facilitate securing the end 38 to the saddle 24. In certain embodiments, the apertures 40 align with apertures (not shown) in the saddle 24 as the end 38 is supported by the saddle 24 such that, as a bolt or rivet is inserted through each of the aligned apertures, the beam 14 is attached to the saddle 24. It is contemplated that the beam 14 can be attached to the saddle 24 using other means for attaching including welding, mechanical fasteners, ties, adhesives, combinations thereof, and the like.

Referring again to FIGS. 3, 4, and 5, studs 42 extend upwardly from the base wall 30, although it is contemplated that some or all of the studs can extend from the side walls. The illustrated studs 42 are formed from flat bars. However, in alternative embodiments, the studs 42 are deformed bar anchors, formed sections of rebar, combinations thereof, and the like.

In the illustrated embodiment, there are two rows of studs 42, each row being aligned longitudinally in the cavity 28 of the beam 14. However, it is, contemplated that the studs 42 can be arranged in a different number of rows or according to an alternative pattern. For example, the studs 42 can be aligned in a single line where adjacent studs 42 have portions that extend in opposite directions to support lengths of rebar R1 on either side of the single line.

One function of the studs 42 is to improve the bond between the beam 14 and the poured bonding core 18, as described in further detail below. In other words, one function of the studs 42 is to anchor the beam 14 to the poured bonding core 18. By way of example and not limitation, in alternative embodiments, means for anchoring can include ribs, fins, anchor bolts, rebar, combinations thereof, and the like. Another function of the studs 42 is to facilitate positioning lengths of rebar R1 in the cavity 28 of the beam 14 prior to the beam 14 receiving a pourable bonding material 18, such as concrete. The studs 42 each include a structure that facilitates attaching the lengths of rebar R1 thereto. In the illustrated embodiment, the illustrated studs 42 include a substantially vertical extending portion 52 and a substantially horizontal extending portion 54. The vertically extending portion 52 extends upwardly from the base wall 30 and the horizontally extending portion 54 extends toward the adjacent side wall 32*a*, 32*b* from the upper distal end of the vertically extending portion 52. The orientation of the extending portions 52, 54 is variable so long as the studs 42 provide a structure for attaching the lengths of rebar R1 thereto. Means for attaching the lengths of rebar R1 to the studs 42 can include welds, ties, adhesives, combinations thereof, and the like. Alternatively, the rebar R1 and the studs 42 can be attached to one another to form structures that are thereafter positioned in the cavities 28 and attached to the beams 14.

As illustrated in FIGS. 3-5, the rebar R1 is attached to the horizontally extending portion 54 of the studs 42. The length of the horizontally extending portion 54 can be increased such that additional lengths of rebar R1 can be attached thereto. Further, lengths of rebar R1 can be attached to the vertically extending portion 52, for example, adjacent the base wall 30. Rebar R1 that is not attached to the studs 42 can also be positioned in the cavities 28.

Referring momentarily to FIGS. 3 and 5, the studs 42 can vary in height. For example, referring to FIG. 3, the height of the studs 42 is substantially that of the flooring sections 16. Referring to FIG. 5, the height of the studs 42 is substantially that of the beam 14. The height of the studs 42 can be selected to control the position of the rebar R1 in the cavities 28.

Referring to FIGS. 1-4, the illustrated flooring sections 16 are pre-cast concrete planks that include hollow voids 60, although it is contemplated that, in alternative embodiments, the flooring sections are metal deck sections, wood planks, solid pre-cast concrete planks, poured-in-place structures, double T planks, single T planks, post-tensioned pre-cast sections, composite structures, combinations thereof, and the like. Referring momentarily to the embodiment illustrated in FIG. 10, a framing structure 100 that includes metal deck sections M is illustrated. Continuing with the embodiment illustrated in FIGS. 1-4, the hollow voids 60 facilitate integration of the flooring sections 16 with the other elements of the framing structure 10, as described in further detail below. In the illustrated embodiment, the hollow voids 60 are plugged with a core stop C that is positioned within the hollow void 60 at a distance from the open end of the hollow void 60.

An exemplary method of constructing the framing structure 10 is now described. It is contemplated that the framing structure 10 can be erected according to alternative methods, for example, by altering the order of the steps of the exemplary method or by adding steps to or omitting steps from the exemplary method.

Figure 6:
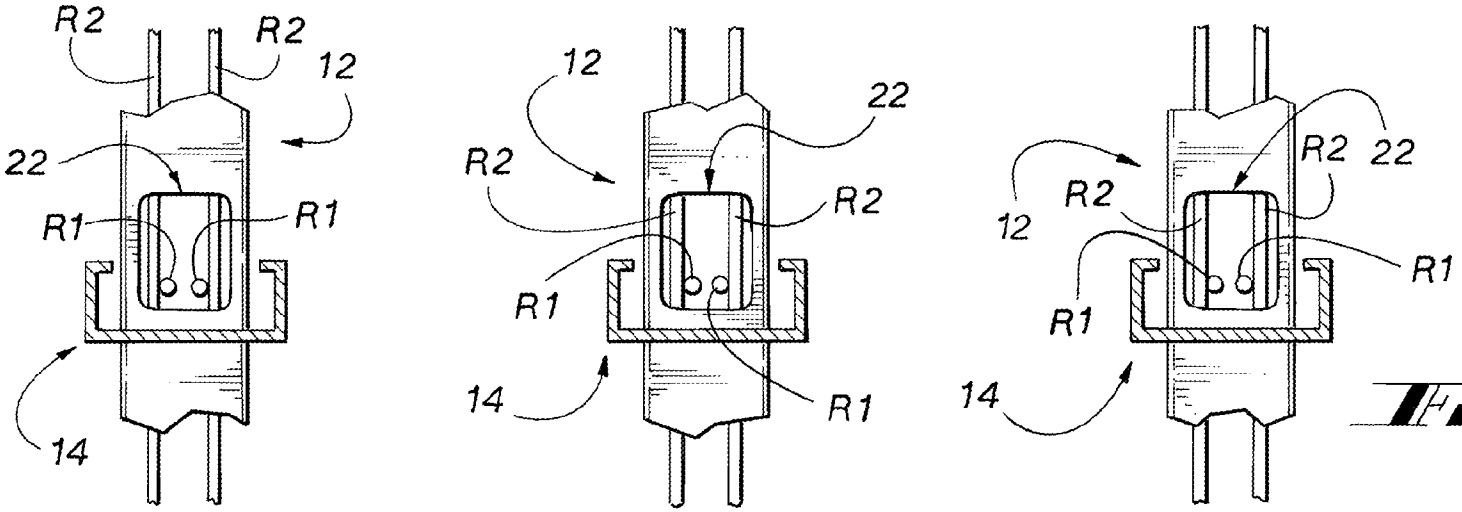
FIGS. 6-9 are fragmentary cross-sectional end views of elements of the framing structure of FIG. 1 that illustrate steps, according to an exemplary method of forming the framing structure of FIG. 1.

Referring first to FIGS. 1 and 6, a plurality of columns 12 are erected and a plurality of beams 14 are positioned to extend longitudinally between erected columns 12 such that the cavities 28 of the beams 14 align with the openings 22 of the columns 12. Specifically, the beams 14 are set on saddles 24 and the columns 12 are received in the cutouts 36. Thereafter, the beams 14 are supported from underneath, longitudinally, and laterally. For added stability, the ends 38 of the beams 14 are attached to the saddles 24.

Referring momentarily to FIGS. 2 and 4, as mentioned above, the ends 38 of adjacent aligned beams 14 abut one another and a column 12 is received in the cutouts 36 therebetween. The abutting ends 38 of the side walls 32*a*, 32*b* of the beams 14 can be attached, such as by bolting or welding, to one another. Thus, abutting beams 14 provide a substantially continuous beam 14 having a base wall 30 that is interrupted by a column 12. It should be noted that the abutting beams 14 are substantially continuous along the side walls 32*a*, 32*b*, the cantilevers 34*a*, 34*b*, and portions of the base walls 30 such that pourable bonding material 18 in the cavities 28 can flow around the exterior of the column 12.

Referring now to FIGS. 1-4, and 7, the illustrated flooring sections 16 are set on erected beams 14 such that one end of each of the flooring sections 16 is supported on the support surface provided by a cantilever 34 a of one beam 14 and the opposite end of each of the flooring sections 16 is supported on the support surface provided by a cantilever 34*b* of another of the beams 14. As such, the hollow voids 60 open to cavities 28. Since abutting beams 14 provide substantially continuous cantilevers 34*a*, 34*b* or are otherwise not interrupted by the columns 12, the flooring sections 16 can abut one another along transverse edges to provide a substantially continuous floor or level, even near the columns 12.

In alternative embodiments, only one end or section of a flooring section 16 is supported by a beam 14 while an opposite end is cantilevered over another beam or supported by another shape of beam.

Figure 7:
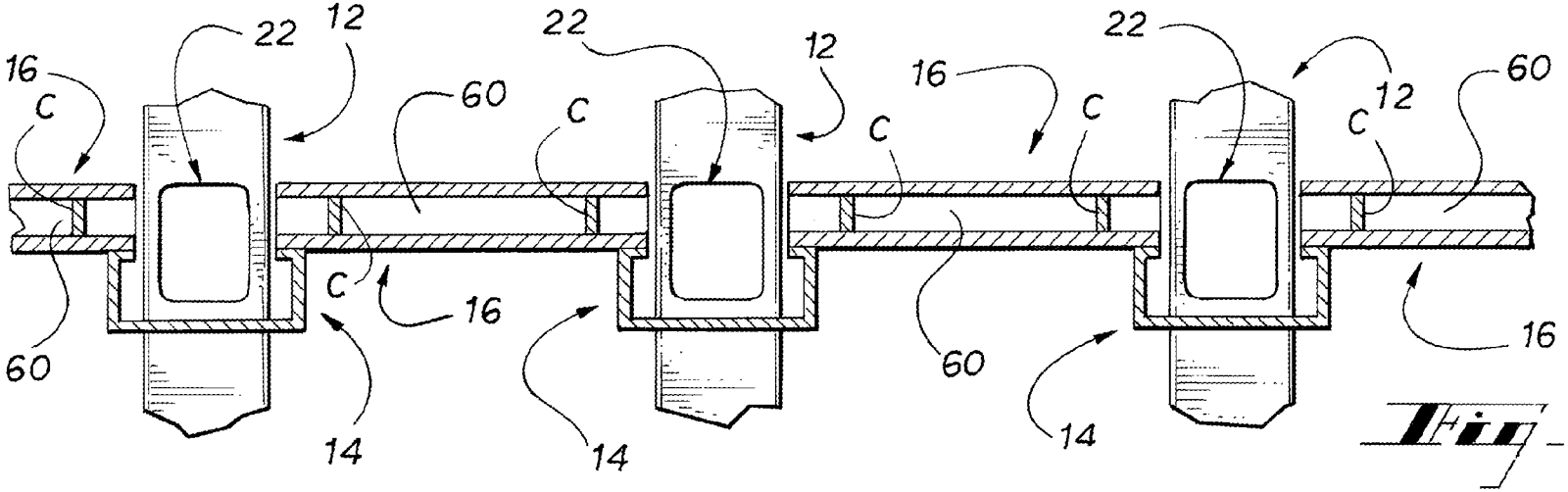

Referring momentarily to FIGS. 3 and 7, the flooring sections 16, in effect, increase the depth of the cavities 28. It should be noted that in the illustrated embodiments, the adjacent ends of the adjacent flooring sections 16 are spaced apart so as to not enclose the cavities 28. As mentioned above, the hollow voids 60 are disposed in the ends of the flooring sections 16 that are adjacent the cavities 28 such that the hollow voids 60 are filled as the cavities 28 are filled. In alternate embodiments, the distance the adjacent ends are spaced apart varies.

Referring now to FIGS. 3-5, lengths of rebar R1 or other reinforcing members such as post tensioned cables (not shown) extend within the cavities 28, and through the openings 22 in the column 12. The illustrated lengths of rebar R1 are tied or otherwise attached to the rows of studs 42. Thereby, the lengths of rebar R1 are positioned within the cavities 28 according to a highly efficient method. Further, referring to FIGS. 4 and 6, lengths of rebar R2 also extend within the hollow interior 26 of the column 12. The lengths of rebar R2 can be tied to the lengths of rebar R1. In any case, the horizontal rebar R1 and the vertical rebar R2 structurally integrate the beams 14, columns 12, and bonding core 18 that solidifies in the cavities 28 and hollow interior 26.

Referring next to FIG. 8, a pourable bonding material 18 such as concrete is poured to first fill the hollow interiors 26. The pourable bonding material 18 can be directly poured into the hollow interiors 26 through the openings 22 or, as the pourable bonding material 18 is poured into the cavities 28, the pourable bonding material 18 is channeled through the openings 22 to fill the hollow interior 26 of the columns 12. Once the columns 12 are filled up to substantially the height of the base wall 30 of the beams 14, the cavities 28 then continue to fill until the level of pourable bonding material 18 reaches the height to fill the beams 14. The cavities 28 continue to fill until the level of pourable bonding material 18 is substantially coplanar with the top surface of the flooring sections 16 so as to fill the hollow voids 60. Since the hollow voids 60 are plugged with the core stops C, the hollow voids 60 are only filled to a certain depth, which reduces the weight of the framing structure 10. Once the pourable bonding material 18 solidifies, the resulting poured bonding core 18 integrally connects the beams 14, the columns 12, and the flooring sections 16 to provide the integrated framing structure 10.

Referring now to FIG. 9, according to another exemplary method, the cavities 28 are filled as in the method described above and pourable bonding material 18 is further poured to define a layer of floor thickness that tops the flooring sections 16. This layer of floor thickness increases the rigidity of the framing structure 10.

Figure 10:
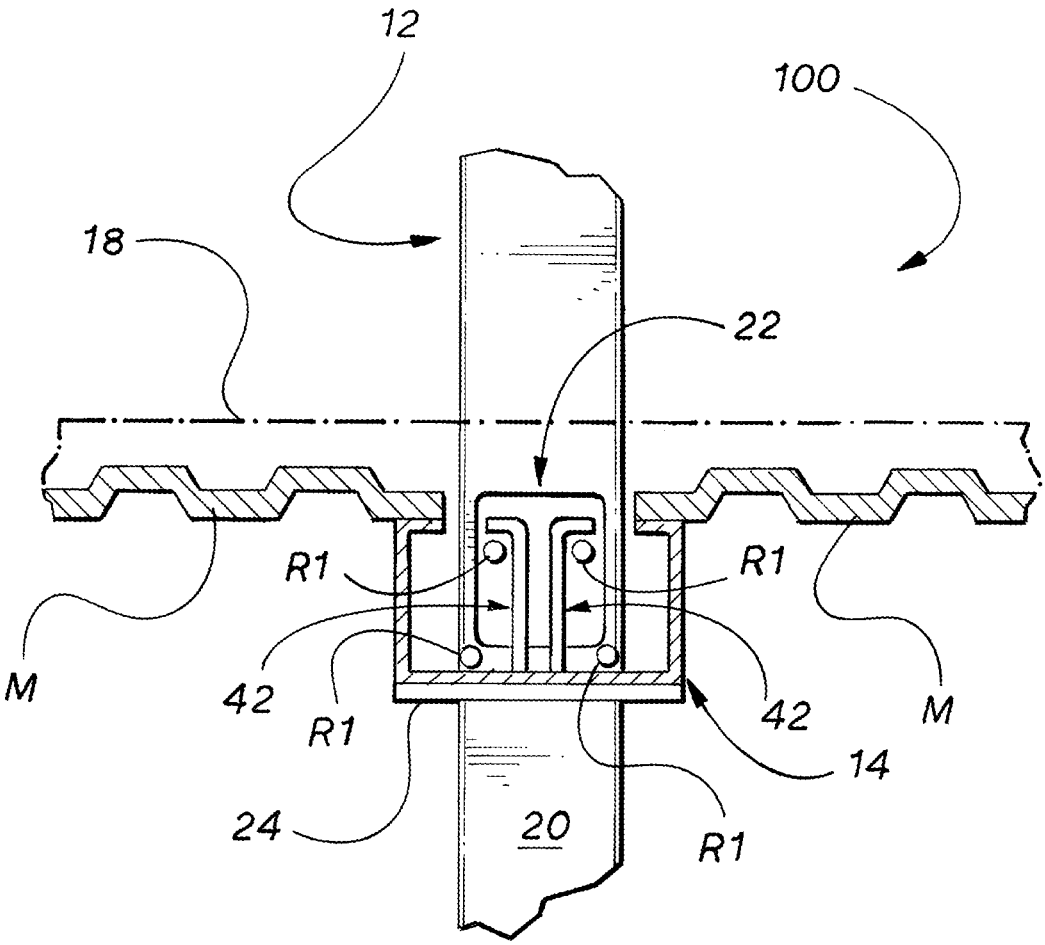
FIG. 10 is a fragmentary cross-sectional end view of a framing structure, according to an alternative embodiment.

Referring to another exemplary embodiment illustrated in FIG. 10 where the flooring sections are metal decking M, according to an alternative method of constructing a framing structure, the cavities 28 are filled in the method described above. Once the cavities 28 are filled, the concrete is further poured to define a layer of floor thickness that tops the metal decking M.

Referring momentarily to FIGS. 3 and 6, the cavities 28 are aligned with the lower portion of the openings 22. The top edge of the opening 22 is vertically above the top surface of the beam 14 and the lower edge of the opening 22 is vertically above the top surface of the base wall 30. Typically, the top surface of the poured bonding core 18 is vertically above the top edge of the opening 22 such that the opening 22 is fully closed after the poured bonding core 18 is formed. In the illustrated embodiment, the upper edge of the opening 22 is slightly below the upper surface of the flooring sections 16. Thus, as a subsequent poured bonding core 18 is formed thereabove, the pourable bonding material 18 does not escape through openings 22 that correspond to lower poured bonding cores 18.

It should be noted that, in certain embodiments, the concrete is poured up to a level to merely fill the columns 12 and the beams 14. In such embodiments the upper edges of the openings 22 are below the support surfaces defined by the cantilevers 34*a*, 34*b* or otherwise the openings 22 are disposed within the areas of the walls 20 of the columns 12 that are defined or overlapped by the cavities 28.

Referring to another exemplary embodiment illustrated in FIG. 11-17, a framing structure 200 includes a column splice structure 202. The column splice structure 202 is configured to splice two columns 12*a*, 12*b* to one another. In addition, the column splice structure 202 is configured to allow for leveling or adjustment and configured to allow a pourable bonding material to flow between columns 12*a*, 12*b* and beams 14*a*, 14*b*.

As described above, the pourable bonding material 18 forms a poured bonding core 18. In this embodiment, the poured bonding core 18 integrally connects columns 12*a*, 12*b* and beams 14*a*, 14*b* and surrounds at least part of the column splice structure 202 to protect and reinforce the connection provided by the column splice structure 202.

Referring to FIGS. 11, 12, 14, 16, and 17, the exemplary column splice structure 202 includes a base plate 204 and a cap plate 206 and adjustable fasteners or connectors that adjustably connect and space apart the base plate 204 to the cap plate 206. The base plate 204 is attached to the bottom of upper column 12*a* and the cap plate 206 is attached to the top of the lower column 12*b*.

Figure 11:
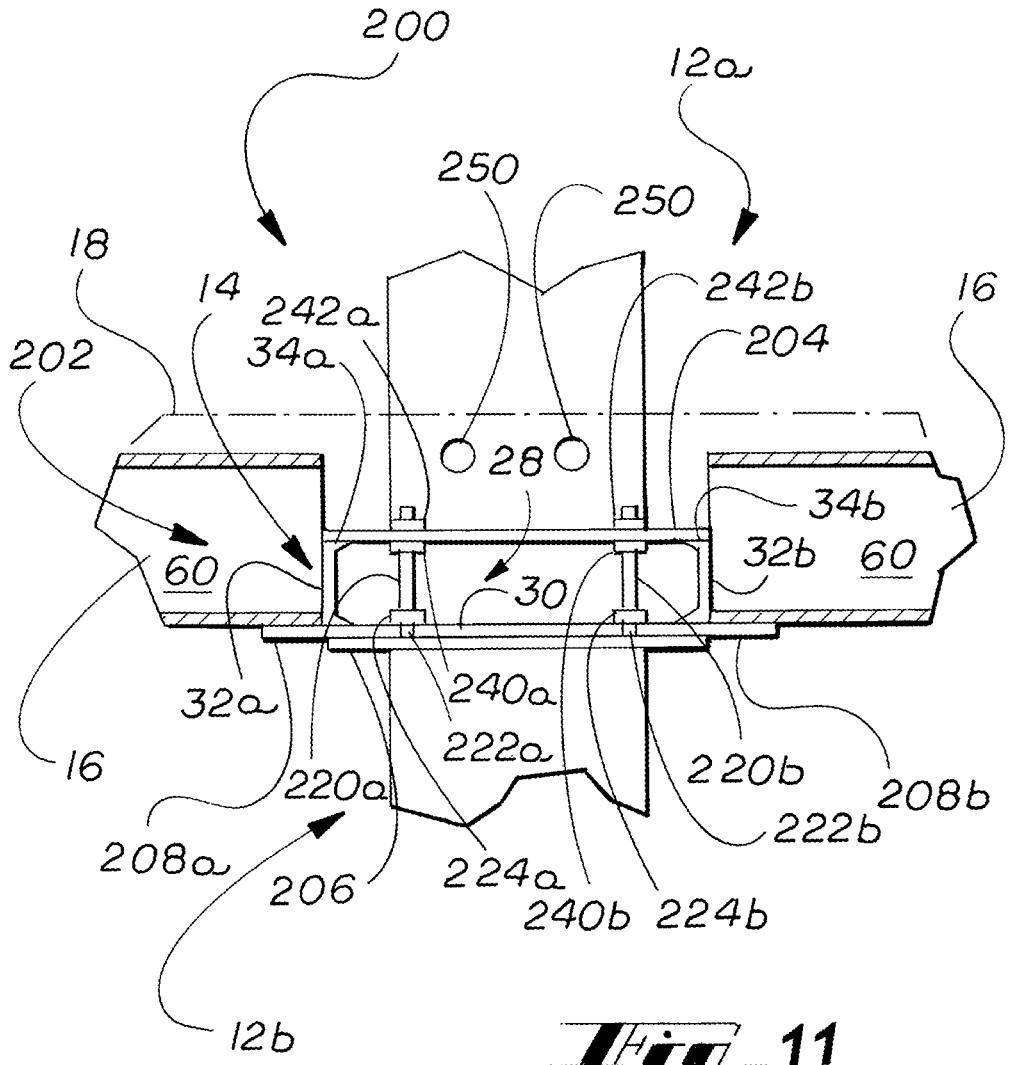
FIG. 11 is a fragmentary end view of elements of a framing structure, according to another alternative embodiment.
Figure 12:
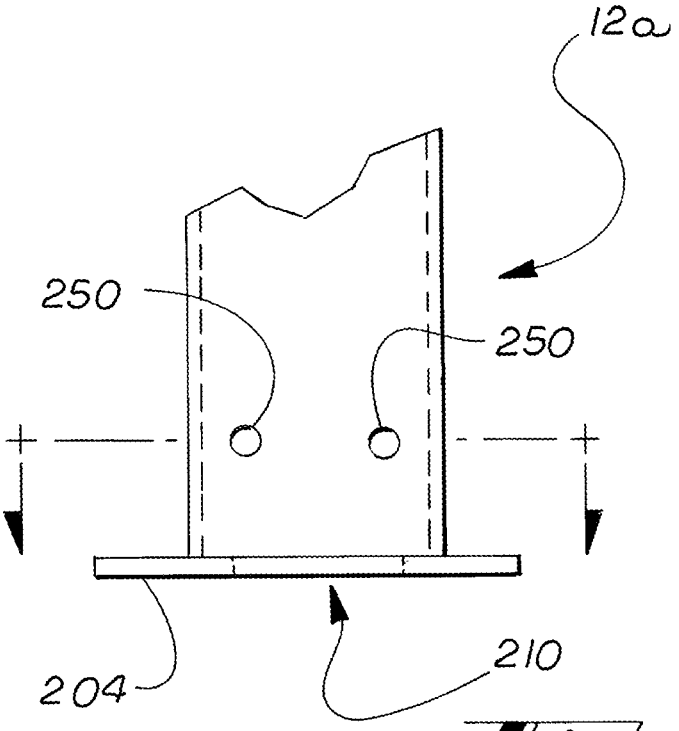
FIG. 12 is a fragmentary end view of elements of the framing structure of FIG. 11.
Figure 14:
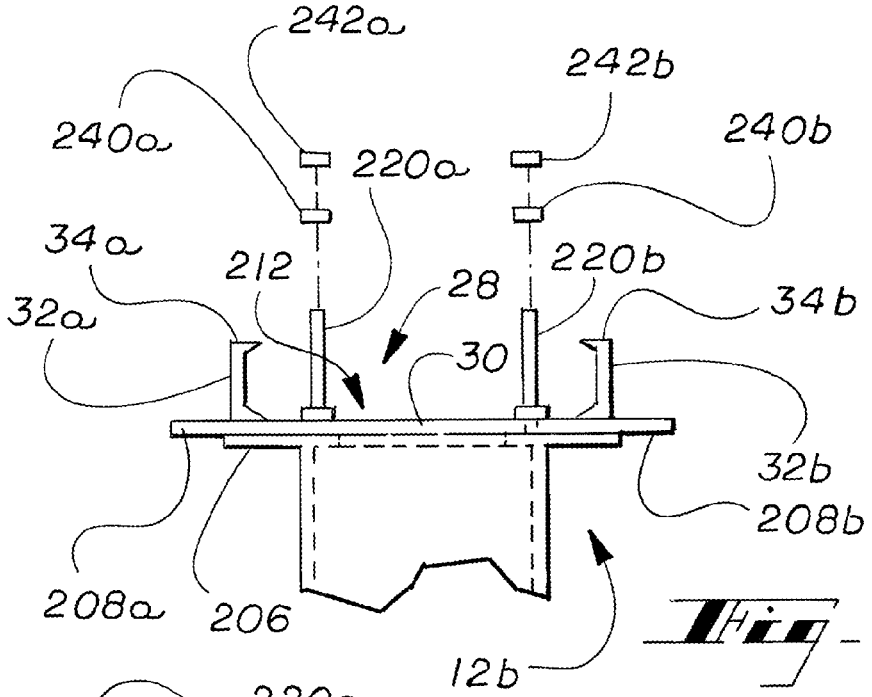
FIG. 14 is a fragmentary cross-sectional end view of elements of the framing structure of FIG. 11.

Referring to FIGS. 11 and 14, the beam 14 includes a base wall 30, side walls 32*a*, 32*b*, and cantilevers 34*a*, 34*b*. The cantilevers 34*a*, 34*b* are configured to support the base plate 204. The base wall 30 extends outside of the side walls 32*a*, 32*b* to provide cantilevers 208*a*, 208*b* on which flooring sections 16 are supported. Alternatively, the flooring sections 16 can be supported on the cantilevers 34*a*, 34*b* as described above. For example, the width of the cantilevers 34*a*, 34*b* can be dimensioned to support both the flooring sections 16 and the base plate 204.

Referring to FIGS. 12-17, the base plate 204 includes a base opening 210 and the cap plate 206 includes a cap opening 212. The openings 210, 212 lead to respective hollow interiors 26*a*, 26*b*. As such, a pourable bonding material 18 can flow between the cavities 28*a*, 28*b* of the beams 14*a*, 14*b* and the hollow interiors 26*a*, 26*b* of the columns 12*a*, 12*b* through the openings 210, 212.

Figure 15:
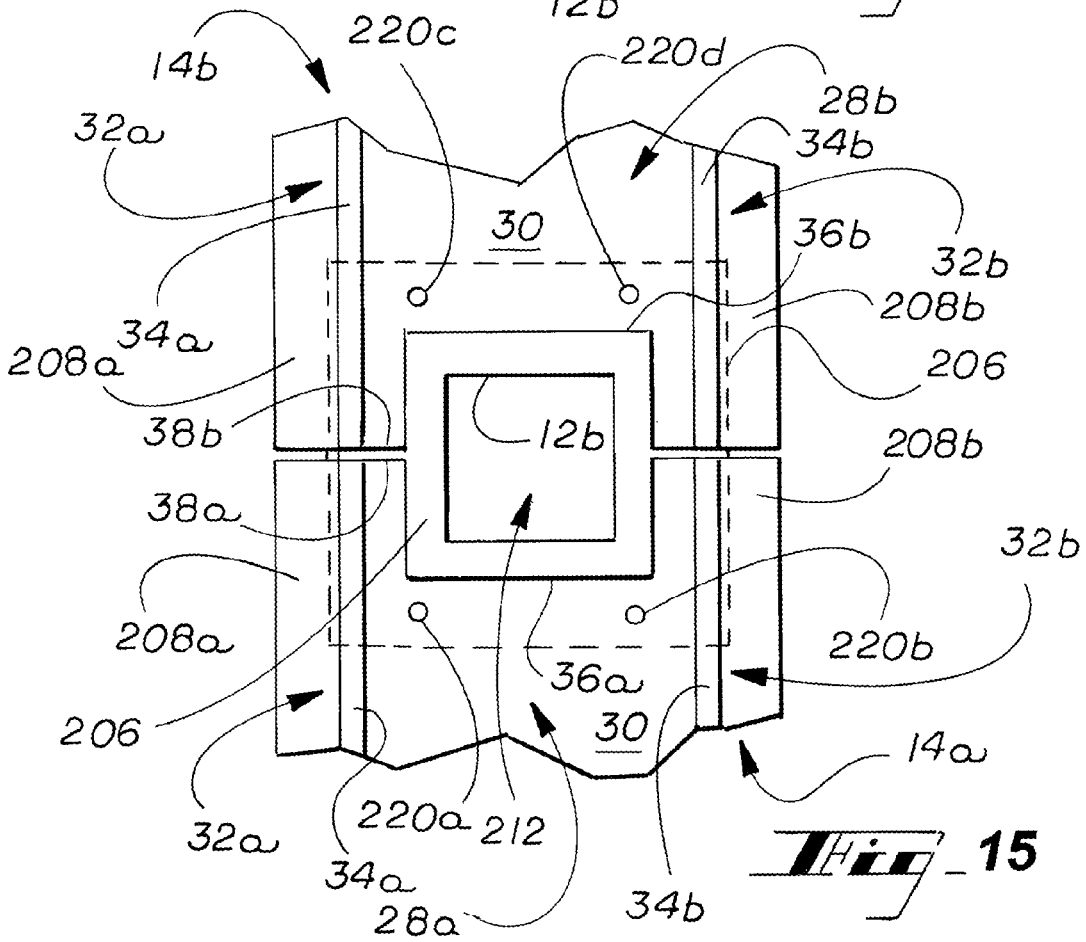
FIG. 15 is a fragmentary plan view of the elements of FIG. 14.

Referring to FIG. 15, each of the beams 14*a*, 14*b* includes a cutout 36*a*, 36*b*. When the beams are supported on the cap plate 206, the cutouts 36*a*, 36*b* of the beams 14*a*, 14*b* align with the edge of the cap opening 212. The ends 38*a*, 38*b* of the beams 14*a*, 14*b* substantially abut one another to, in effect, provide a continuous beam 14 with an opening aligned with the cap opening 212.

Exemplary adjustable fasteners include nuts and bolts. Referring to FIGS. 11 and 14, bolts 220*a*, 220*b*, 220*c*, 220*d* are secured to and extend upwardly from the base wall 30. Alternatively or additionally, the bolts are secured to and extend upwardly from the cap plate 206. The bolts 220 are secured in apertures 222 by nuts 224. Alternatively or additionally, bolts can be secured by threading into threaded apertures, welding, or other fastening means.

Figure 13:
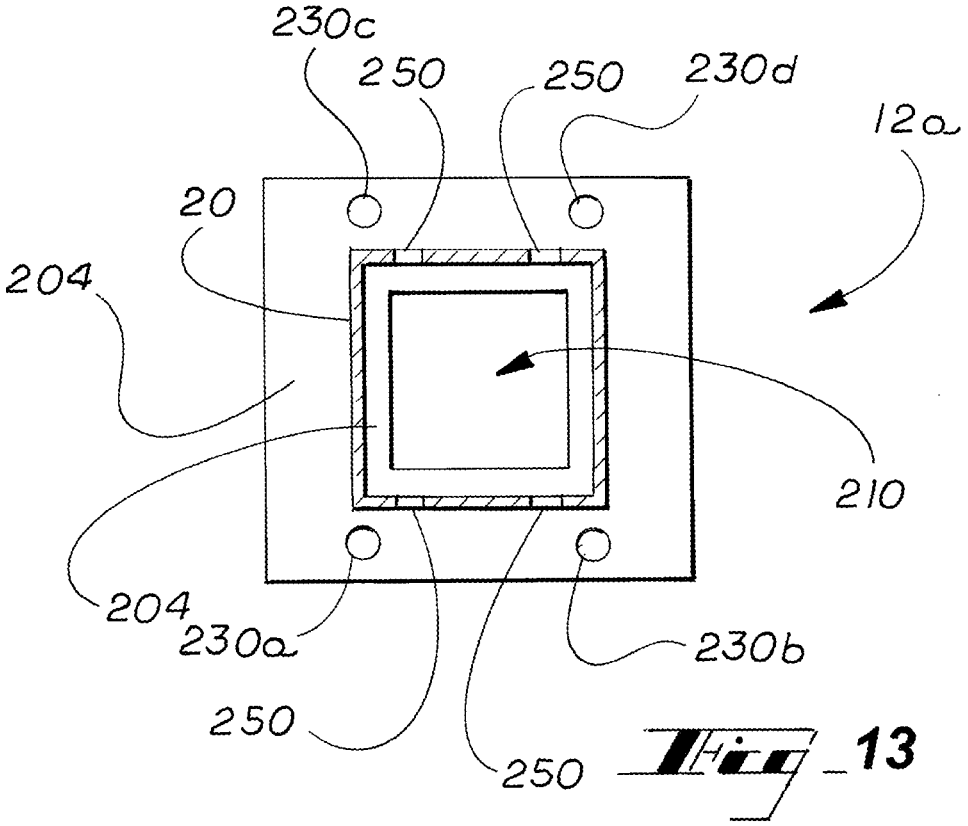
FIG. 13 is a cross-sectional plan view of the elements of FIG. 12.

Referring to FIG. 13, the base plate 204 includes apertures 230 corresponding to bolts 220. When the base plate 204 rests on the cantilevers 34*a*, 34*b*, the bolts 220 extend through the apertures 230. Adjusting nuts 240, 242 are threaded onto the bolts 220 above and below the base plate 204. The adjusting nuts 240, 242 are adjustable along a length of the bolts 220 to adjust the height at which the bolts 220 support the column 12*a*. As such the adjusting nuts 240, 242 facilitate leveling the base plate 204 and upper column 12*a*.

Figure 16:
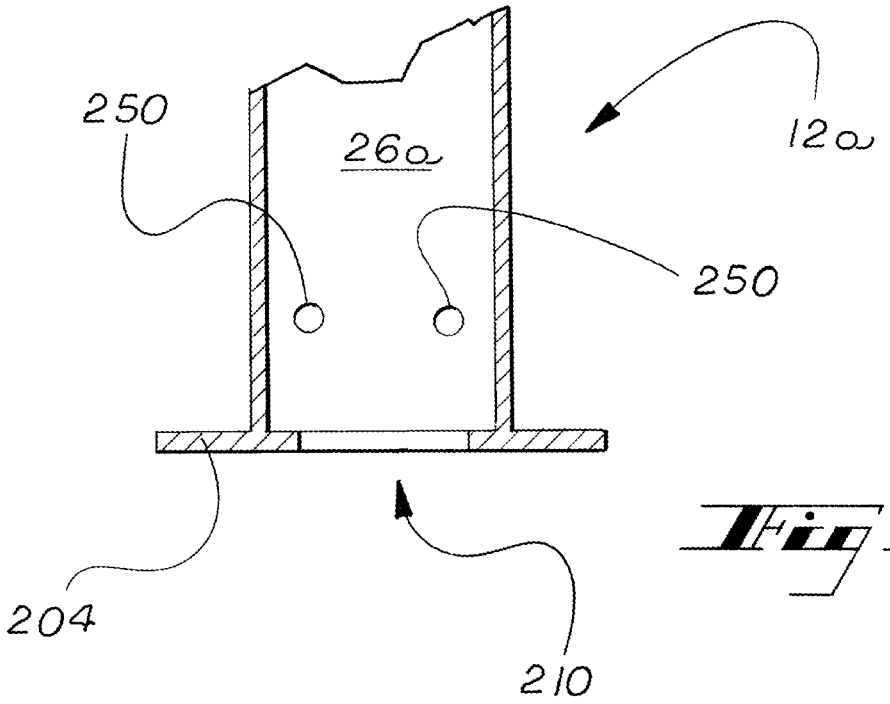
FIGS. 16 and 17 are fragmentary cross-sectional end views of columns of the framing structure of FIG. 11.

Referring to FIGS. 11 and 16, the upper column 12*a* includes apertures 250 to receive rebar to reinforce the poured bonding core 18. The apertures 250 are positioned at a distance away from the base plate 204 at which the apertures 250 will position rebar in the poured bonding core 18 along the length of the beams 14. The rebar also extends through the hollow interior 26 as described above.

Figure 17:
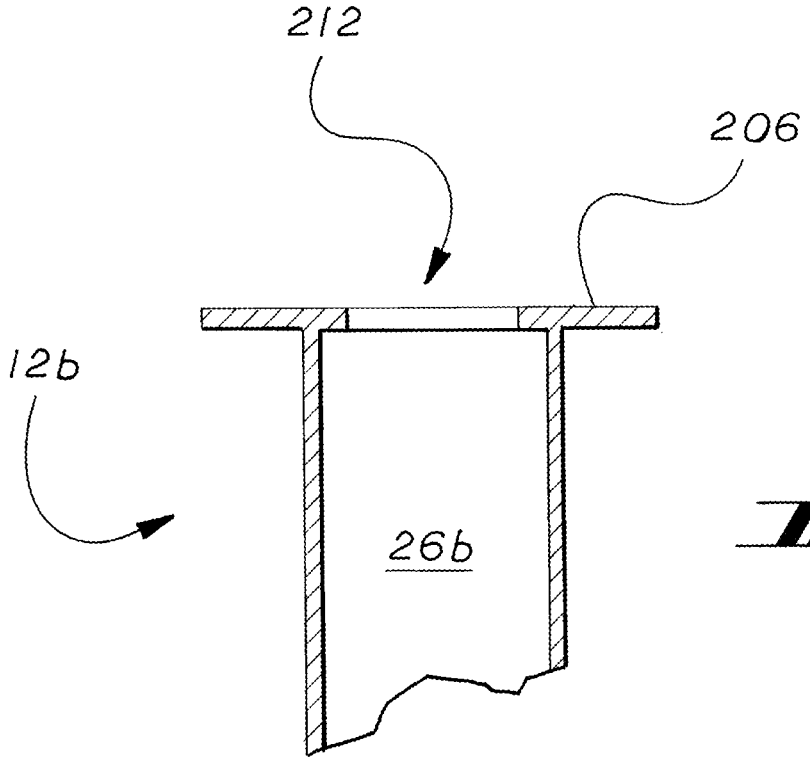

Referring to FIGS. 11, 16, and 17, the pourable bonding material 18 can be poured substantially as above except that the pourable bonding material 18 flows through the openings 210, 212 and the space between the columns 12*a*, 12*b* (i.e., the space between the base plate 204 and the cap plate 206) instead of through an opening 22.

For example, the pourable bonding material 18 is poured to first fill the hollow interior 26*a* of the upper column 12*a*. The pourable bonding material 18 can be directly poured into the hollow interior 26*a* and flow through the base opening 210 into the cavities 28*a*, 28*b* (see FIG. 15) and lower hollow interior 26*b* through the cap opening 212. Or, as the pourable bonding material 18 is poured into the cavities 28*a*, 28*b*, the pourable bonding material 18 is channeled through the openings cap 212 to fill the hollow interior 26*b* of the lower columns 12*b*.

Once the lower column 12*b* is filled up to substantially the height of the base wall 30 of the beams 14*a*, 14*b*, the cavities 28*a*, 28*b* then continue to fill until the level of pourable bonding material 18 reaches the height to fill the beams 14*a*, 14*b*. The cavities 28*a*, 28*b* continue to fill until the level of pourable bonding material 18 is substantially coplanar with the top surface of the flooring sections 16, thereby filling the hollow voids 60. The pourable bonding material 18 can be further poured to a level to form a layer on top of the flooring sections 16 as shown in FIG. 11. Once the pourable bonding material 18 solidifies, the resulting poured bonding core 18 integrally connects the beams 14, the columns 12, and the flooring sections 16 to provide the integrated framing structure 10. In addition, the poured bonding core 18 integrally connects columns 12 and beam 14 and surrounds at least part of the column splice structure 202 to protect and reinforce the connection provided by the column splice structure 202

Figure 19:
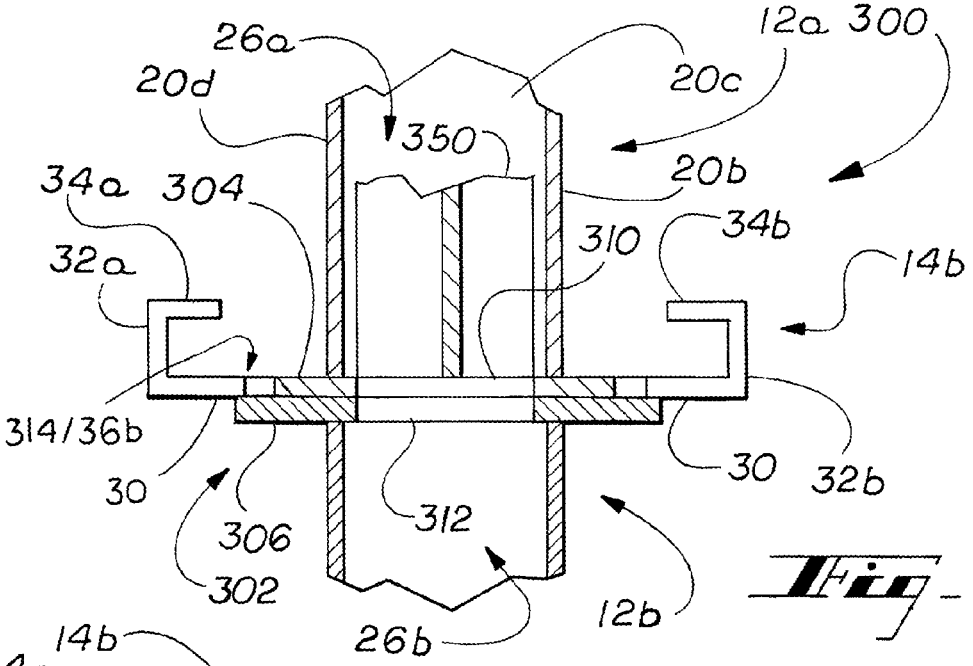
FIG. 19 is a fragmentary cross-sectional end view of elements of the framing structure of FIG. 18.
Figure 18:
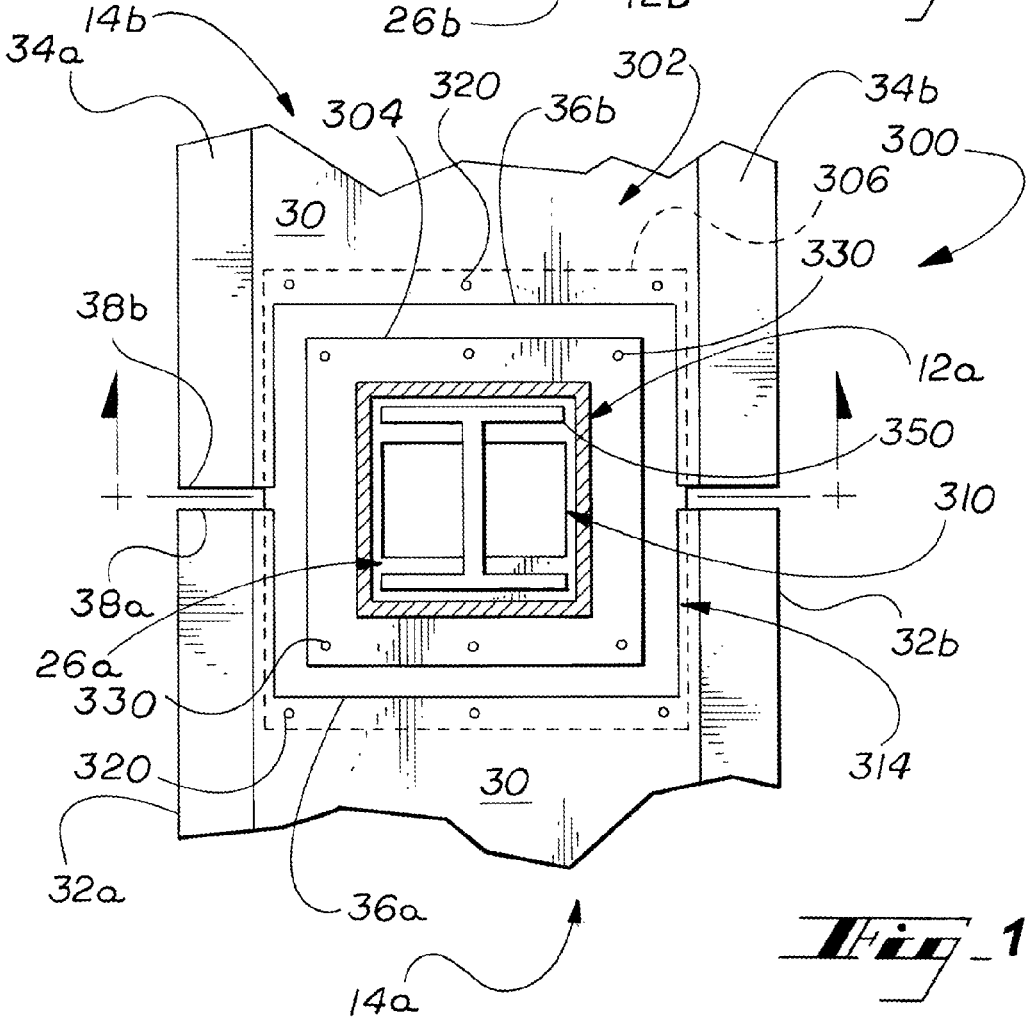
FIG. 18 is a fragmentary plan view of elements of a framing structure, according to an exemplary embodiment.
Figure 20:
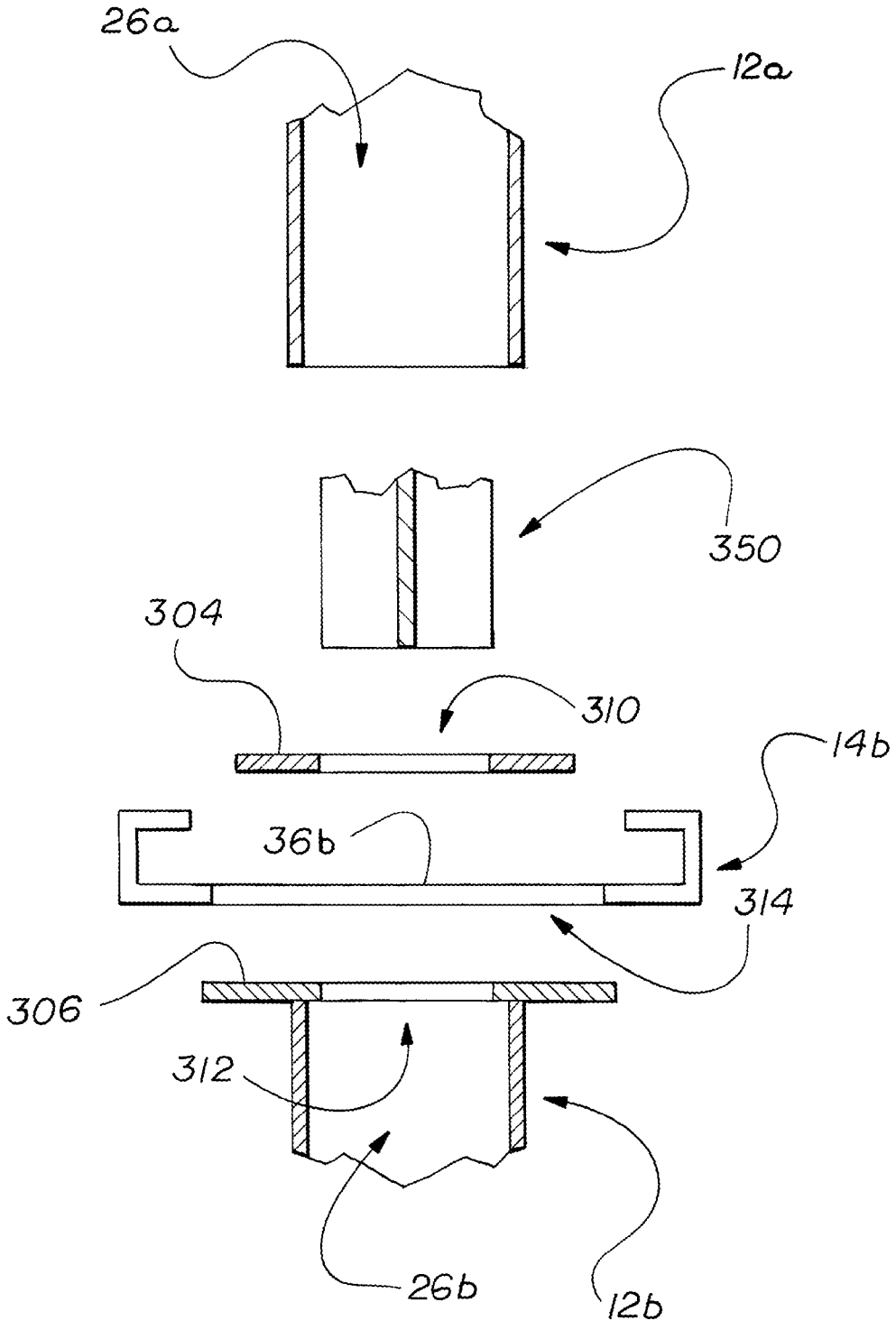
FIG. 20 is an exploded fragmentary cross-sectional end view of elements of the framing structure of FIG. 18.

Referring to another exemplary embodiment illustrated in FIGS. 18-20, a framing structure 300 includes a column splice structure 302. The column splice structure 302 is configured to splice two columns 12*a*, 12*b* to one another.

As described above, the pourable bonding material 18 forms a poured bonding core 18. In this embodiment, the poured bonding core 18 integrally connects columns 12*a*, 12*b*. In certain embodiments, as above, the beams 14*a*, 14*b* include openings 22 (e.g., as shown in FIG. 2) and the bonding core 18 further integrally connects beams 14*a*, 14*b*.

Referring to FIGS. 18-20, the exemplary column splice structure 302 includes a base plate 304, a cap plate 306, and fasteners or connectors that connect the base plate 304 to the cap plate 306. After the assembly method described below, the base plate 304 is attached to the bottom of upper column 12*a* and the cap plate 306 is attached to the top of the lower column 12*b*.

Referring to FIGS. 18-20, the base plate 304 includes a base plate opening 310 and the cap plate 306 includes a cap plate opening 312. The openings 310, 312 lead to respective hollow interiors 26*a*, 26*b*. As such, a pourable bonding material 18 can flow between the hollow interiors 26*a*, 26*b* of the columns 12*a*, 12*b* through the openings 310, 312.

Referring momentarily to FIGS. 18-20, an exemplary method of assembly is described. The beams 14*a*, 14*b* are supported on the cap plate 306 (see FIGS. 19 and 20) and attached to the cap plate 306 with bolts 320 (see FIG. 18).

Referring to FIG. 18, each of the beams 14*a*, 14*b* includes a cutout 36*a*, 36*b*. When the beams are supported on the cap plate 306, the cutouts 36*a*, 36*b* of the beams 14*a*, 14*b* frame the cap plate opening 312. The ends 38*a*, 38*b* of the beams 14*a*, 14*b* substantially abut one another to, in effect, provide a continuous beam 14 with a beam opening 314. The beam opening 314 aligns with the cap plate opening 312 (e.g., the openings are coaxial). The areas of the openings 312, 314 at least partially overlap to allow flow through the openings 312, 314.

Referring to FIG. 18, the bolts 320 secure the base walls 30 of the beams 14*a*, 14*b* to the cap plate 306. For example, the bolts 320 are secured in apertures by nuts. Alternatively or additionally, bolts can be secured by threading into threaded apertures, or the beams can be secured to the cap plate by welding or other fastening means.

Referring to FIGS. 19-20, the base plate 304 is received in the beam opening 314, supported on the cap plate 306, and is attached to the cap plate 306. Referring to FIG. 18, bolts 330 secure the base plate 304 to the cap plate 306. As shown in FIG. 19, the base plate 304 rests on the cap plate 306. Referring to FIG. 18, the bolts 330 extend through aligned apertures in the plates 304, 306.

Referring to FIGS. 19-20, an I-beam 350 rests on the base plate 304 and is attached to the base plate, for example, by welding. Referring to FIG. 18, a cross-section of the I-beam 350 extends across the area of the base plate opening 310 without blocking the base plate opening 310.

Referring to FIGS. 19-20, the upper column 12*a* (e.g., the tube) slides over the I-beam 350, rests on the base plate 304, and is attached to the base plate 304, for example, by welding. As such, the I-beam extends through the hollow interior 26*a* of the upper column 12*a*. The I-beam 350 (e.g., a wide flange) reinforce the poured bonding core 18 in the upper column 12*a*.

Although not shown, the upper column 12*a* can include a cap plate 306 and the column splice structure 302 can be repeated with the upper column 12*a* now as a "lower" column.

The pourable bonding material 18 can be poured to flow through the openings 310, 312, 314. For example, the pourable bonding material 18 is poured to into the hollow interior 26*a* of the upper column 12*a*. The pourable bonding material 18 can be directly poured into the hollow interior 26*a* and flow through the base plate opening 310 into the lower hollow interior 26*b* through the beam opening 314 and the cap opening 212.

Figure 22:
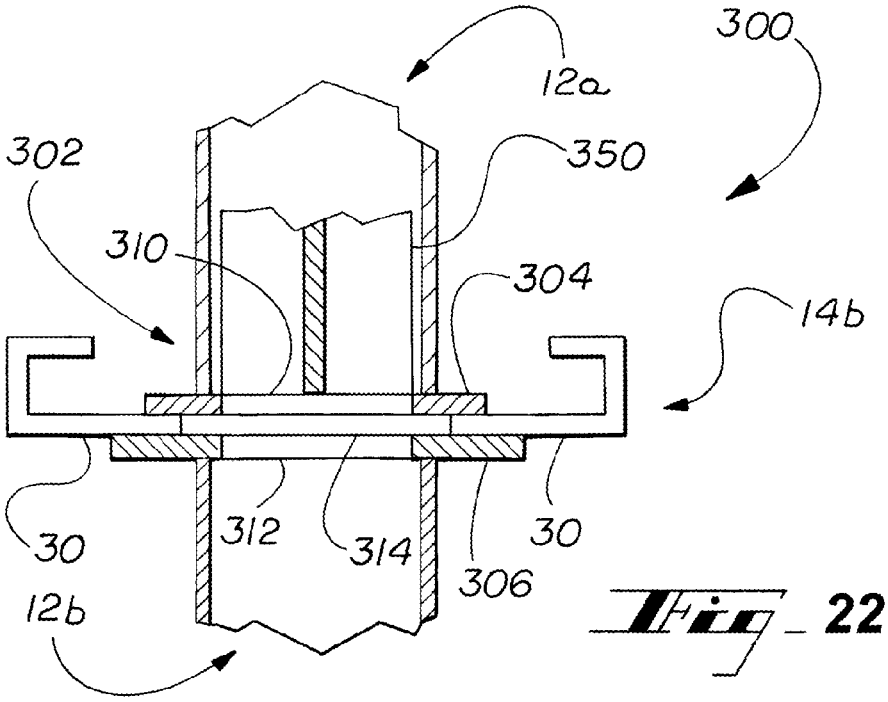
FIG. 22 is a fragmentary cross-sectional end view of elements of the framing structure of FIG. 22.
Figure 21:
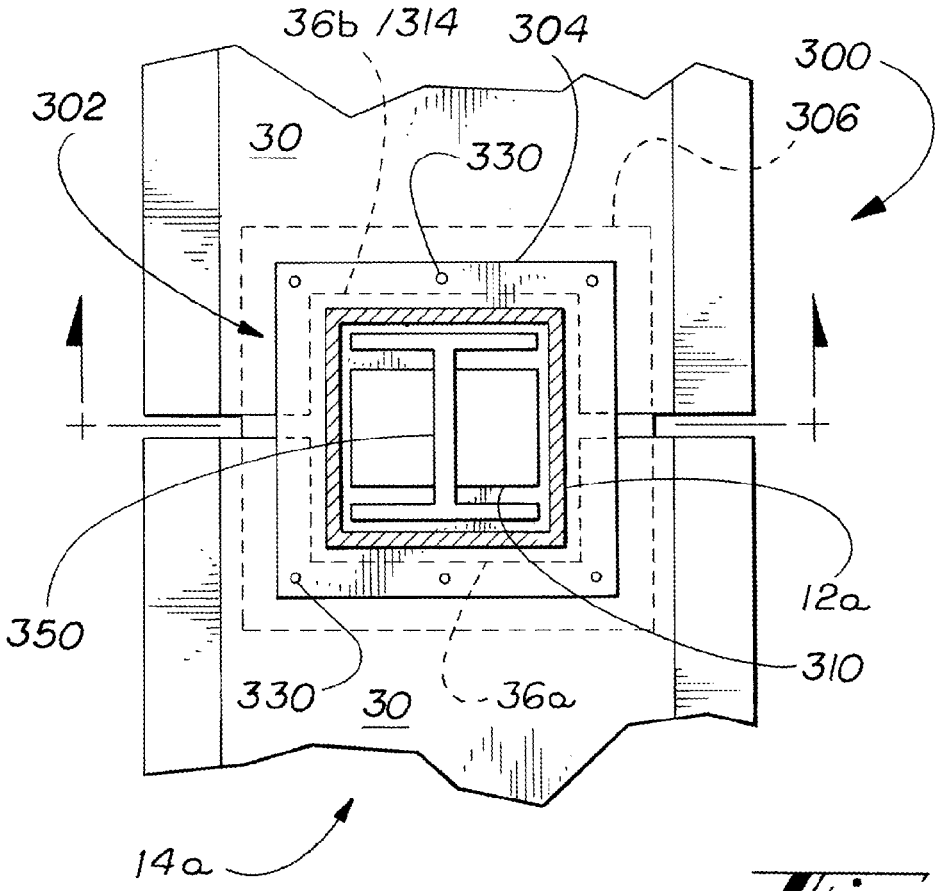
FIG. 21 is a fragmentary plan view of elements of a framing structure, according to an exemplary embodiment.

According to another embodiment shown in FIGS. 21-22, the cutouts 36*a*, 36*b* are smaller and form a smaller beam opening 314. Here, the base plate 304 rests on, and is secured to, the base walls 30 of the beams 14*a*, 14*b* with bolts 330. The bolts 330 extend through aligned apertures in each of the base plate 304, the base walls 30 of the beams 14*a*, 14*b*, and the cap plate 306.

Figure 23:
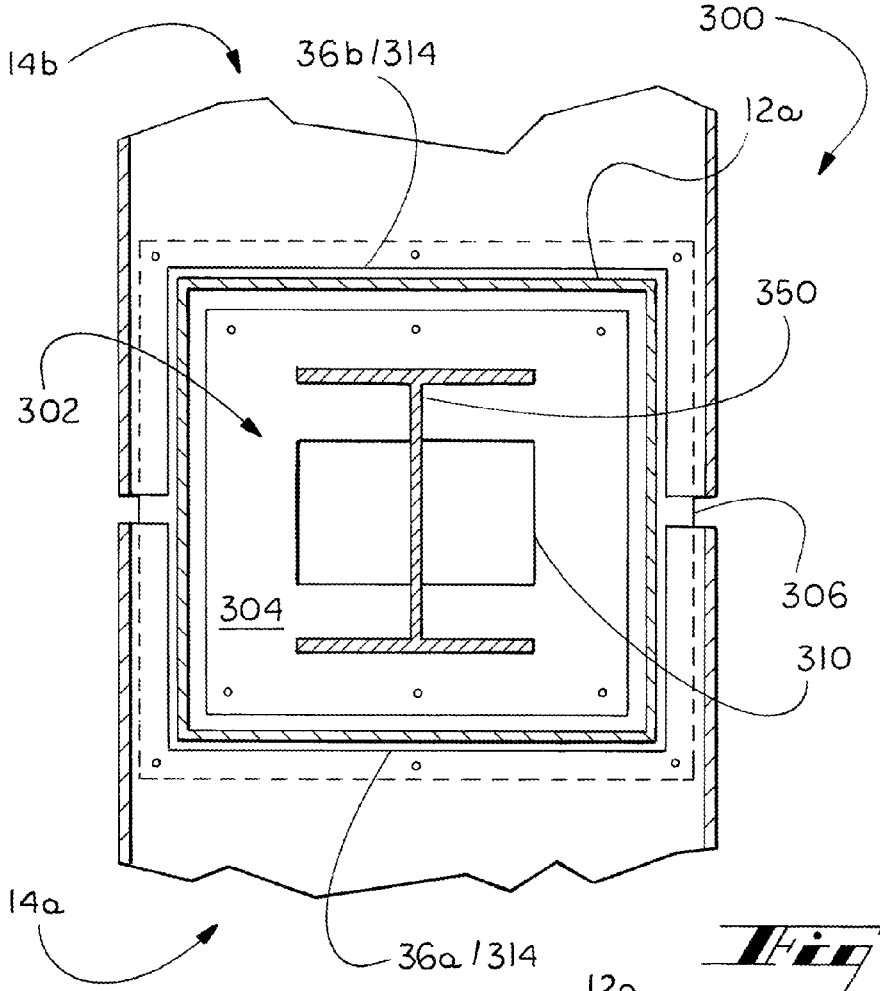
FIG. 23 is a fragmentary plan view of elements of a framing structure, according to an exemplary embodiment.
Figure 24:
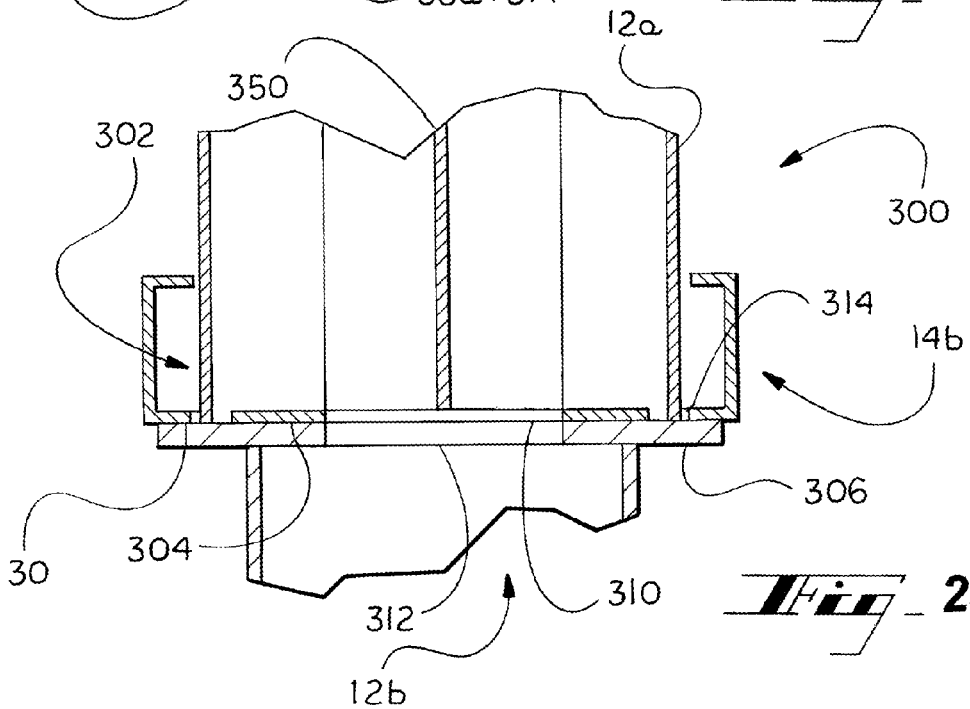
FIG. 24 is a fragmentary cross-sectional end view of elements of the framing structure of FIG. 23.

According to another embodiment shown in FIGS. 23-24, the base plate 304 is smaller. Here, as above, the base plate 304 rests on and is secured to the cap plate 306; the I-beam 350 rests on and is secured to the base plate 304. In contrast to the embodiments above, the upper column 12*a* rests on and is secured to the cap plate 306. Alternatively, the upper column 12*a* rests on and is secured to the base walls 30 of the beams 14*a*, 14*b*.

According to another embodiment, the base plate 304 is omitted, the I-beam 350 rests on and is secured to the cap plate 306, and the upper column 12*a* rests on and is secured to one of the cap plate 306 and the base walls 30 of the beams 14*a*, 14*b*.

The law does not require and it is economically prohibitive to illustrate and teach every possible embodiment of the present claims. Hence, the above-described embodiments are merely exemplary illustrations of implementations set forth for a clear understanding of principles. Variations, modifications, and combinations may be made to the above-described embodiments without departing from the scope of the claims. All such variations, modifications, and combinations are included herein by the scope of this disclosure and the following claims.

The invention claimed is:

1. A framing structure, comprising:

an upper column, comprising:

a first hollow interior; and a base plate at a lower end of the upper column, the base plate comprising a base plate opening to the first hollow interior;

a lower column, comprising:

a second hollow interior; and a top plate at an upper end of the lower column, the top plate comprising a top plate opening to the second hollow interior;

a first beam, comprising:

a first base wall that is substantially parallel to the top plate; a first side wall extending upwardly from the first base wall;

a second side wall extending upwardly from the first base wall; and a first cutout in the first base wall at a first end of the first beam; and a second beam, comprising:

a second base wall that is substantially parallel to the top plate; a third side wall extending upwardly from the second base wall;

a fourth side wall extending upwardly from the second base wall; and a second cutout in the second base wall at a second end of the second beam; and wherein the first end of the first beam and the second end of the second beam are supported by the top plate such that the first cutout and the second cutout define a beam opening that aligns with the second opening and wherein the base plate is supported by the first side wall, second side wall, third side wall, and fourth side wall; and an I-beam extending in the first hollow interior and supported on the base plate.

2. The framing structure of claim 1, wherein a cross sectional area of the I-beam extends across the base plate opening.

3. The framing structure of claim 1, wherein the base plate abuts the top plate.

4. The framing structure of claim 1, wherein the base plate abuts the first base wall and the second base wall.

5. The framing structure of claim 1, the upper column extending in a substantially vertical direction, the lower column extending in a substantially vertical direction, the first beam extending in a substantially horizontal direction, and the second beam extending in a substantially horizontal direction.

6. The framing structure of claim 1, wherein the first cutout is an end of the first base wall and the second cutout is in an end of the second base wall.

7. The framing structure of claim 1, wherein the first cutout is an edge of the first base wall and the second cutout is in an edge of the second base wall.

8. The framing structure of claim 1, wherein the first cutout and the second cutout align with an edge of the second opening.

9. The framing structure of claim 1, wherein the first cutout and the second cutout define an third opening that aligns with the second opening such that the second opening and the third opening are substantially coaxial.

10. The framing structure of claim 9, wherein the third opening further aligns with the first opening such that the first opening, the second opening, and the third opening are substantially coaxial.

11. The framing structure of claim 1, wherein the first end of the first beam substantially abuts the second end of the second beam.

12. The framing structure of claim 1, wherein the first base wall substantially abuts the second base wall.

13. The framing structure of claim 1, further comprising a poured bonding core that at least partially fills the first hollow interior, the second hollow interior, the first beam, and the second beam.

14. The framing structure of claim 1, each of the first beam and the second beam comprising a cantilever that is configured to support a flooring section.

15. The framing structure of claim 14, wherein the cantilever of the first beam is coplanar with the first base wall and the cantilever of the second beam is coplanar with the second base wall.

16. The framing structure of claim 1, further comprising a flooring section.

17. The framing structure of claim 16, wherein the flooring section is selected from a group consisting of a metal deck section and a pre-cast concrete plank.

18. The framing structure of claim 17, further comprising a poured bonding core that integrally connects the upper column, lower column, the first beam, the second beam, and the flooring section.

19. The framing structure of claim 18, wherein the poured bonding core includes a layer on top of the flooring section.

* * * * *